US011560259B2

(12) United States Patent
Hirst et al.

(10) Patent No.: US 11,560,259 B2
(45) Date of Patent: Jan. 24, 2023

(54) LIQUID-DISPENSING CONTAINER WITH MULTIPLE-POSITION SELECTOR

(71) Applicant: Runway Blue, LLC, Alpine, UT (US)

(72) Inventors: Nathan K. Hirst, Spanish Fork, UT (US); Jim A. Colby, Highland, UT (US); David O. Meyers, Layton, UT (US); Joseph O. Jacobsen, American Fork, UT (US)

(73) Assignee: Runway Blue, LLC, Alpine, UT (US)

( * ) Notice: Subject to any disclaimer, the term of this patent is extended or adjusted under 35 U.S.C. 154(b) by 0 days.

(21) Appl. No.: 16/989,260

(22) Filed: Aug. 10, 2020

(65) Prior Publication Data

US 2021/0009317 A1 Jan. 14, 2021

Related U.S. Application Data

(63) Continuation of application No. 16/548,403, filed on Aug. 22, 2019, now Pat. No. 10,737,845, which is a
(Continued)

(51) Int. Cl.
*B65D 35/46* (2006.01)
*A47G 19/22* (2006.01)
(Continued)

(52) U.S. Cl.
CPC ..... *B65D 35/46* (2013.01); *A47G 19/2266* (2013.01); *A47G 21/18* (2013.01);
(Continued)

(58) Field of Classification Search
CPC ..... B65D 35/46; B65D 47/24; B65D 47/263; A47G 19/2266; A47G 21/18
(Continued)

(56) References Cited

U.S. PATENT DOCUMENTS 3,170,633 A 2/1965 Castelli
3,937,364 A 2/1976 Wright
(Continued)

FOREIGN PATENT DOCUMENTS

CN 101730492 6/2010
CN 101730651 6/2010
(Continued)

OTHER PUBLICATIONS

International Search Report and Written Opinion from PCT Application No. PCT/US2015/056493, dated Jan. 6, 2016 (7 pgs).
(Continued)

*Primary Examiner* — J. Gregory Pickett
*Assistant Examiner* — Niki M Eloshway
(74) *Attorney, Agent, or Firm* — Sterne, Kessler, Goldstein & Fox P.L.L.C.

(57) ABSTRACT

A liquid-dispensing container may include a vessel, lid body, valve assembly, selector and/or straw. The selector may be movable between a first position that allows fluid disposed within the container to be discharged through a straw, and a second position that allows fluid within the container to be discharged by inverting and/or squeezing the container. The selector may be movable into a closed position that restricts fluid from being discharged from the container. The selector may be movable into a detachment position that allows for detachment of the selector from a remainder of the container, disassembly of the valve assembly, or both.

22 Claims, 23 Drawing Sheets

Related U.S. Application Data continuation of application No. 15/242,211, filed on Aug. 19, 2016, now Pat. No. 10,414,549.

(51) Int. Cl.

| | |
|---|---|
| ***B65D 47/26*** | (2006.01) |
| ***A47G 21/18*** | (2006.01) |
| ***B65D 47/06*** | (2006.01) |
| ***B65D 47/24*** | (2006.01) |

(52) U.S. Cl.
CPC ..... *B65D 47/06* (2013.01); *B65D 47/24* (2013.01); *B65D 47/263* (2013.01)

(58) Field of Classification Search
USPC ..... 215/229
See application file for complete search history.

(56) References Cited

U.S. PATENT DOCUMENTS

| | | | | |
|---|---|---|---|---|
| 4,286,636 | A | 9/1981 | Credle | |
| 4,768,667 | A | 9/1988 | Magnusson | |
| D308,828 | S | 6/1990 | Magnusoon | |
| 4,976,364 | A | 12/1990 | Solomon | |
| D339,503 | S | 9/1993 | Callaway | |
| 5,326,006 | A | 7/1994 | Giard, Jr. | |
| D350,672 | S | 9/1994 | Egger et al. | |
| 5,545,315 | A | 8/1996 | Lonneman | |
| D391,448 | S | 3/1998 | Winer et al. | |
| D398,478 | S | 9/1998 | Spencer | |
| 5,984,141 | A * | 11/1999 | Gibler | A47J 41/0027 206/219 |
| D427,909 | S | 7/2000 | Doritty et al. | |
| 6,135,311 | A | 10/2000 | Panec | |
| 6,523,711 | B1 | 2/2003 | Hughes et al. | |
| 6,971,551 | B2 | 12/2005 | Widgery | |
| 7,204,382 | B2 | 4/2007 | Cezeaux | |
| D586,183 | S | 2/2009 | Junkel | |
| D600,973 | S | 9/2009 | Lane | |
| D608,204 | S | 1/2010 | Caroen et al. | |
| D608,640 | S | 1/2010 | Carreno | |
| 7,651,003 | B2 | 1/2010 | Albers et al. | |
| D609,969 | S | 2/2010 | McKinney | |
| 7,775,394 | B2 | 8/2010 | Naesje | |
| D626,409 | S | 11/2010 | Hooley | |
| 8,051,674 | B2 | 11/2011 | Roth et al. | |
| D655,569 | S | 3/2012 | Lipson | |
| D657,194 | S | 4/2012 | McIntire et al. | |
| D660,081 | S | 5/2012 | Gilbert | |
| 8,272,525 | B1 | 9/2012 | La Torre et al. | |
| 8,336,724 | B2 | 12/2012 | Yamashita et al. | |
| D675,865 | S | 2/2013 | Wahl | |
| 8,505,783 | B2 * | 8/2013 | Gill | A45F 3/20 222/212 |
| 8,505,793 | B2 | 8/2013 | Foley | |
| D689,331 | S | 9/2013 | Staton | |
| D690,162 | S | 9/2013 | Staton | |
| D690,556 | S | 10/2013 | Boroski | |
| D691,420 | S | 10/2013 | McIntire | |
| 8,602,238 | B2 | 12/2013 | El-Saden | |
| 8,695,836 | B1 | 4/2014 | Gregory | |
| D707,492 | S | 6/2014 | George et al. | |
| D724,895 | S | 3/2015 | Kawase et al. | |
| D725,436 | S | 3/2015 | Miller | |
| D725,967 | S | 4/2015 | Peng | |
| D736,562 | S | 8/2015 | Green et al. | |
| 9,102,447 | B2 * | 8/2015 | Pils | B65D 47/247 |
| D760,027 | S | 6/2016 | Meyers et al. | |
| 9,498,086 | B2 | 11/2016 | Waggoner | |
| 9,694,953 | B2 | 7/2017 | Meyers et al. | |
| 10,246,228 | B2 * | 4/2019 | Meyers | B65D 47/247 |
| 10,414,549 | B2 * | 9/2019 | Hirst | B65D 35/46 |
| 10,737,845 | B2 * | 8/2020 | Hirst | B65D 35/46 |
| 2003/0168474 | A1 | 9/2003 | Widgery | |
| 2004/0188280 | A1 | 9/2004 | Young | |
| 2005/0115966 | A1 | 6/2005 | Leoncavallo et al. | |
| 2005/0121405 | A1 | 6/2005 | Drajan | |
| 2006/0283896 | A1 | 12/2006 | Kasting | |
| 2010/0108700 | A1 | 5/2010 | Scott | |
| 2010/0123019 | A1 | 5/2010 | Zehavi | |
| 2010/0270337 | A1 | 10/2010 | Green et al. | |
| 2011/0248054 | A1 | 10/2011 | Darby | |
| 2012/0012617 | A1 | 1/2012 | Gill et al. | |
| 2012/0187157 | A1 | 7/2012 | Yuan | |
| 2013/0214012 | A1 | 8/2013 | Pils | |
| 2014/0263476 | A1 | 9/2014 | Blain et al. | |
| 2014/0319183 | A1 | 10/2014 | Choi et al. | |
| 2015/0164254 | A1 | 6/2015 | Niedens | |
| 2015/0196148 | A1 | 7/2015 | Hoskins | |
| 2015/0210443 | A1 | 7/2015 | Sarson | |
| 2016/0150898 | A1 | 6/2016 | Hoskins | |
| 2016/0200486 | A1 | 7/2016 | Meyers et al. | |
| 2018/0050844 | A1 | 2/2018 | Hirst et al. | |

FOREIGN PATENT DOCUMENTS

| | | |
|---|---|---|
| CN | 102099251 | 6/2011 |
| GB | 1080873 | 8/1967 |
| JP | S5761272 | 4/1982 |
| KR | 200190169 | 7/2000 |
| WO | 2005032948 | 4/2005 |
| WO | 2007069257 | 6/2007 |
| WO | 2008084256 | 7/2008 |
| WO | 2016111736 | 7/2016 |
| WO | 2018034731 | 2/2018 |

OTHER PUBLICATIONS

Office Action issued in U.S. Appl. No. 14/592,267 dated Sep. 23, 2016 (7 pgs).
Examination Report issued in Australian Application No. 2015375450 dated Sep. 4, 2018 (3 pgs).
Extended European Search Report dated Aug. 24, 2018 in Application No. 15877288.9 (8 pgs).
First Office Action for Chinese Application No. 2016100061521, dated Jun. 1, 2017 (40 pgs).
Office Action issued in U.S. Appl. No. 15/624,352 dated Aug. 28, 2018 (6 pgs).
Final Office Action issued in U.S. Appl. No. 15/624,352 dated Feb. 9, 2018 (6 pgs).
Office Action issued in U.S. Appl. No. 15/624,352 dated Aug. 4, 2017 (7 pgs).
Second Office Action for Chinese Application No. 2016100061521, dated Nov. 30, 2017 (4 pgs).
Examination Report issued in Australian Application No. 2015375450 dated Dec. 19, 2017 (3 pgs).
Examination Report issued in Canadian Application No. 2,972,250 dated Apr. 23, 2018 (4 pgs).
Search Report issued in Russian Application No. 2017124655 dated May 16, 2018 (4 pgs).
International Search Report dated Sep. 15, 2017 as received in Application No. PCT/US2017/038346, dated Sep. 15, 2017 (15 pgs).
Written Opinion of the International Searching Authority dated Sep. 15, 2017 as received in Application No. PCT/US2017/038346 (8 pgs).

* cited by examiner

LIQUID-DISPENSING CONTAINER WITH MULTIPLE-POSITION SELECTOR

CROSS-REFERENCE TO RELATED APPLICATION

This application is a continuation of U.S. patent application Ser. No. 16/548,403, filed Aug. 22, 2019, titled "LIQUID-DISPENSING CONTAINER WITH MULTIPLE-POSITION SELECTOR," which is a continuation of U.S. patent application Ser. No. 15/242,211, filed Aug. 19, 2016, titled "LIQUID-DISPENSING CONTAINER WITH MULTIPLE-POSITION SELECTOR." Each of these applications is incorporated herein in its entirety by reference thereto.

FIELD OF THE DISCLOSURE

This disclosure is generally directed to containers and container lids and, in some embodiments, more specifically to liquid-dispensing containers and container lids that may include a multiple-position selector.

BACKGROUND

Containers may hold a variety of different types of liquids such as water, beverages, drinks, juices and the like. Containers also can hold various items such as energy drinks, protein drinks, shakes, foodstuffs, dressings, sauces, and liquid meal replacements. Fluid can be dispensed from some containers by inverting them and allowing the contents to flow downward through an opening (e.g., by pouring). Some containers are configured to dispense their contents by squeezing the container while an opening of the container is downwardly oriented.

SUMMARY

Orienting a container so that an opening of the container is facing downwardly for dispensing the liquid (possibly requiring inversion of the container) can be undesirable in some situations. For example, beverage containers may be used in situations in which (i) the consumer's attention is directed to an activity or event other than beverage consumption, (ii) the beverage is consumed from the container during movement of the consumer, or (iii) both. Examples of these situations include exercising, and operating or riding in a vehicle. As a more specific example, a bicyclist or motorist must tilt his or her head back and divert his or her attention from the road, at least temporarily, in order to consume the contents of a squeeze-type or pour-type container.

Also, the inherent requirement to elevate a squeeze-type or pour-type container can be undesired in some situations. For example, in circumstances where space may be limited or where concealment is desired, it may be difficult or undesirable to elevate a container (e.g., a squeeze-type or pour-type container) and/or position the consumer's head for drinking from the container.

Even during leisurely or slow-paced activities, such as walking or watching a film, a person may not want to tilt his or her head back and raise to the extent required (and possibly also invert and/or squeeze) a container in order to consume the contents of the container.

In situations in which (i) the consumer's attention is directed to an activity or event other than beverage consumption, (ii) the beverage is consumed from the container during movement of the consumer, or (iii) both, a container equipped with a straw may be useful. However, to use a straw with a conventional container may require removal of a cap and/or insertion of the straw into an opening into the container. This process may be time-consuming, require physical dexterity, and involve loss of the straw before it is used. In addition, straw-equipped containers may allow the contents to spill or leak through the opening and/or the straw, especially when the container is full. Also, the presence of a straw extending into the container can prevent or impair removal of the contents of the container without using the straw. Physical removal of the straw to permit or facilitate removal of the contents without using the straw, however, may undesirably take a significant amount of time, require physical dexterity, and involve loss of some of the contents. Additionally, it may be especially difficult to consume all or the last contents of many straw-equipped containers, which may waste some of the contents and the remaining contents may disadvantageously leak from the container. Further, fast, high-volume consumption of the liquid, which may be desired during or after sports activities or when a person is particularly dehydrated, can be difficult to achieve through a straw, especially when the contents of the container are low. Some conventional containers may include straws that remain in a single position unless removed from the container. The straw in these types of containers typically spans nearly the length of the interior cavity of the container, which makes it virtually impossible to drink from these types of containers without using the straw while the straw is equipped.

Aspects of the present disclosure address one or more of these and/or other deficiencies. For example, some aspects of the present disclosure relate to a container that can be used to dispense liquid through a straw while the container is in an upright position and through a separate fluid path when the container is not in the upright position. Advantageously, this may provide the benefit of both a straw-equipped container and a non-straw-equipped container in a single system. Furthermore, the subject matter recited in the appended claimed may address some, none, or all of the deficiencies mentioned herein.

The subject technology is illustrated, for example, according to various aspects described below. Various examples of aspects of the subject technology are described as numbered clauses (1, 2, 3, etc.) for convenience. These are provided as examples and do not limit the subject technology. It is noted that any of the dependent clauses may be combined in any combination, and placed into a respective independent clause, e.g., Clause 1, 16, or 19. The other clauses can be presented in a similar manner. The following is a non-limiting summary of some examples presented herein.

Clause 1. A liquid-dispensing container comprising:
- a vessel;
- a lid attachable to the vessel, the lid comprising:
- a lid body;
- a straw connector coupled to the lid body;
- a nozzle; and
- a valve assembly attached to the lid body and the nozzle, the valve assembly comprising:
  - a selector movable relative to the lid body between a closed position, a first open position and a second open position;
  - a conduit coupled with the selector, and comprising a conduit opening in fluid communication with an interior passage of the conduit; and
  - a valve body coupled to the conduit, the valve body comprising a first opening and a second opening; and a straw couplable to the straw connector, wherein when the selector is in the closed position, fluid flow between the valve body and an interior passage of the conduit is blocked, wherein when the selector is in the first open position, a first fluid pathway extends from an interior of the vessel to the interior passage of the conduit through the straw connector and the first opening in the valve body, and wherein when the selector is in the second open position, a second fluid pathway extends from the interior of the vessel to the interior passage of the conduit through the second opening in the valve body.

Clause 2. The liquid-dispensing container as in Clause 1, wherein:

when the selector is in the closed position, fluid is restricted from flowing through each of the first fluid pathway and the second fluid pathway;

when the selector is in the first open position, fluid is restricted from flowing through the second fluid pathway; and when the selector is in the second open position, fluid is restricted from flowing through the first fluid pathway.

Clause 3. The liquid-dispensing container as in Clause 1, wherein movement of the selector relative to the lid body moves the conduit relative to the lid body;

wherein the straw connector is coupled to the lid body in a fixed position; and wherein the valve body is disposed in a fixed position relative to the lid body.

Clause 4. The liquid-dispensing container as in Clause 1, wherein positioning of the selector relative to the valve body determines whether fluid can flow within the first fluid pathway or the second fluid pathway.

Clause 5. The liquid-dispensing container as in Clause 1, wherein the conduit opening is disposed in a sidewall of the conduit.

Clause 6. The liquid-dispensing container as in Clause 1, wherein the first opening in the valve body is at least partially disposed in an end of the valve body and a sidewall of the valve body; and wherein the second opening in the valve body is at least partially disposed in the sidewall of the valve body.

Clause 7. The liquid-dispensing container as in Clause 1, further comprising an opening through an interior wall of the lid body, the opening through the interior wall of the lid body at least substantially aligned with the second opening in the valve body, wherein, when the selector is in the second open position, fluid may pass from the interior of the vessel through the second opening in the valve body and through the opening through the interior wall of the lid body into the interior passage of the conduit.

Clause 8. The liquid-dispensing container as in Clause 1, wherein:

no fluid flows from within the straw through the first opening into the interior of the conduit when the valve assembly is in the second open position; and the straw and the interior of the conduit are in fluid communication through the first opening when the valve assembly is in the first open position.

Clause 9. The liquid dispensing container as in Clause 1, wherein at least one of the selector and the lid body comprises a notch, and at least the other of the selector and the lid body comprises a protrusion sized and shaped to cooperate with the notch, and coupling of the notch with the protrusion resists movement of the selector from at least one position of the selector relative to the lid body.

Clause 10. The liquid-dispensing container as in Clause 1, wherein:

when the selector is in the second open position, a fluid can be discharged from the container by orienting the container with the nozzle directed downwardly, and applying a suction to the nozzle or squeezing the container; and when the selector is in the first open position, the fluid can be discharged from the container through the straw by applying a suction to the nozzle.

Clause 11. The liquid-dispensing container as in Clause 1, further comprising a position indicator sized and shaped to indicate a position of the selector, a first open position marker that corresponds to the first open position, and a second open position marker that corresponds to the second open position;

wherein when the selector is in the first open position, the position indicator is substantially aligned with the first position marker; and wherein when the selector is in the second open position, the position indicator is substantially aligned with the second open position marker.

Clause 12. The liquid-dispensing container as in Clause 1, wherein the selector, when assembled with the lid body and the valve body, is rotatable between the closed position, the first open position, and the second open position.

Clause 13. The liquid-dispensing container as in Clause 12, wherein:

the selector comprises a groove;

the lid body comprises a key that is sized and shaped to pass through the groove during assembly of the selector and the lid body; and rotation of the selector between the closed position, the first open position, and the second open position comprises relative movement of the groove and the key.

Clause 14. The liquid-dispensing container as in Clause 1, wherein the selector is movable relative to the lid body into a detachment position.

Clause 15. The liquid-dispensing container as in Clause 14, wherein the selector is detachable from the lid body when the selector is in the detachment position, and wherein the selector is not detachable from the lid body when the selector is in the closed position, the first open position and the second open position.

Clause 16. An apparatus comprising:

a conduit comprising an interior passage and a conduit opening in fluid communication with the interior passage;

a selector coupled to the conduit; and a valve body coupled to the conduit, the valve body comprising a first opening and a second opening;

wherein the selector is rotatable relative to the valve body between a closed position, a first open position and a second open position;

wherein the conduit opening is positioned to align with the first opening of the valve body when the selector is in the first open position, wherein fluid is prevented from entering the valve body through the second opening of the valve body when the selector is in the first open position;

wherein the conduit opening is positioned to align with the second opening of the valve body when the selector is in the second open position, wherein fluid is prevented from entering the valve body through the first opening of the valve body when the selector is in the second open position; and wherein when the selector is in the closed position, the conduit is positioned to prevent fluid flow between the valve body and the selector.

Clause 17. The apparatus of Clause 16, further comprising a straw coupled to the first opening of the valve body, and wherein when the selector is in the first open position, a first fluid pathway extends from an interior passage of the straw to the interior passage of the conduit through the first opening in the valve body.

Clause 18. The apparatus of Clause 17, wherein when the selector is in the second open position, a second fluid pathway extends from the second opening in the valve body to the interior passage of the conduit.

Clause 19. A liquid-dispensing container comprising:

a vessel;

a lid body attached to the vessel; and a selector attached to the lid body, the selector rotatably movable relative to the lid body between a closed position, a first open position and a second open position;

wherein when the selector is in the closed position, the selector prevents fluid flow between the vessel and an interior passage of the selector;

wherein when the selector is in the first open position, a first fluid pathway allows the fluid to be removed from the body by suction through a straw; and wherein when the selector is in the second open position, a second fluid pathway allows the fluid to be removed from the vessel by at least one of inverting or squeezing the vessel.

Clause 20. The liquid-dispensing container of Clause 19, wherein when the selector is in the closed position, the fluid is restricted from flowing through the first fluid pathway or the second fluid pathway;

wherein when the selector is in the first open position, the fluid is restricted from flowing into the interior passage of the selector through the second fluid pathway; and wherein when the selector is in the second open position, the fluid is restricted from flowing into the interior passage of the selector through the first fluid pathway.

These and other aspects, features, and advantages of the subject technology will become more fully apparent from the following brief description of the drawings, the drawings, the detailed description of preferred embodiments, and appended claims.

BRIEF DESCRIPTION OF THE DRAWINGS

The appended drawings are incorporated in and constitute a part of this description, and contain figures of certain embodiments to further disclose the above and other aspects, principles, advantages, and features of the subject technology. It will be appreciated that these drawings depict only certain embodiments and are not intended to limit the scope of the invention. Additionally, it will be appreciated that while the drawings may illustrate certain sizes, scales, relationships, and configurations of the subject technology, the drawings are not intended to limit the scope of the claimed invention.

DETAILED DESCRIPTION

The detailed description set forth below includes a description of various configurations of the subject technology and is not intended to represent the only configurations in which the subject technology may be practiced. The detailed description includes specific details for the purpose of providing a thorough understanding of the subject technology. However, the subject technology may be practiced without these specific details. In some instances, well-known structures and components are not shown, or are shown schematically, to avoid obscuring the concepts of the subject technology.

Although various aspects, principles, advantages, and features of the subject technology are disclosed herein with reference to liquid-dispensing containers or container lids or, more specifically in some instances, squeeze bottles, the present invention is not limited to liquid-dispensing containers or container lids or to squeeze bottles. It will be understood that, in light of the present disclosure, the liquid-dispensing containers disclosed herein may have a variety of suitable shapes, sizes, configurations, and arrangements. It will also be understood that containers and container lids according to the subject technology can include any suitable number of parts and components, such as vessels, selectors, valve bodies, nozzles, lid bodies, straws, and the like; and the containers and container lids may include any appropriate number and combination of features, parts, aspects, and the like. The disclosed components can be combined or subdivided in some embodiments of the subject technology. In addition, while the accompanying figures illustrate containers and container lids having particular styles and configurations, it will be appreciated that the claimed subject matter may not be limited to the illustrated styles and configurations. Further, the containers and container lids may be successfully used in connection with other types of devices.

Various exemplifying embodiments are shown in the accompanying figures. To assist in the description of the various exemplifying embodiments, words such as top, bottom, front, rear, sides, right, and left may be used to describe the accompanying figures which may be, but are not necessarily, drawn to scale. It will further be appreciated that the containers may be disposed in a variety of desired positions or orientations, and used in numerous locations, environments, and arrangements.

Figure 1:
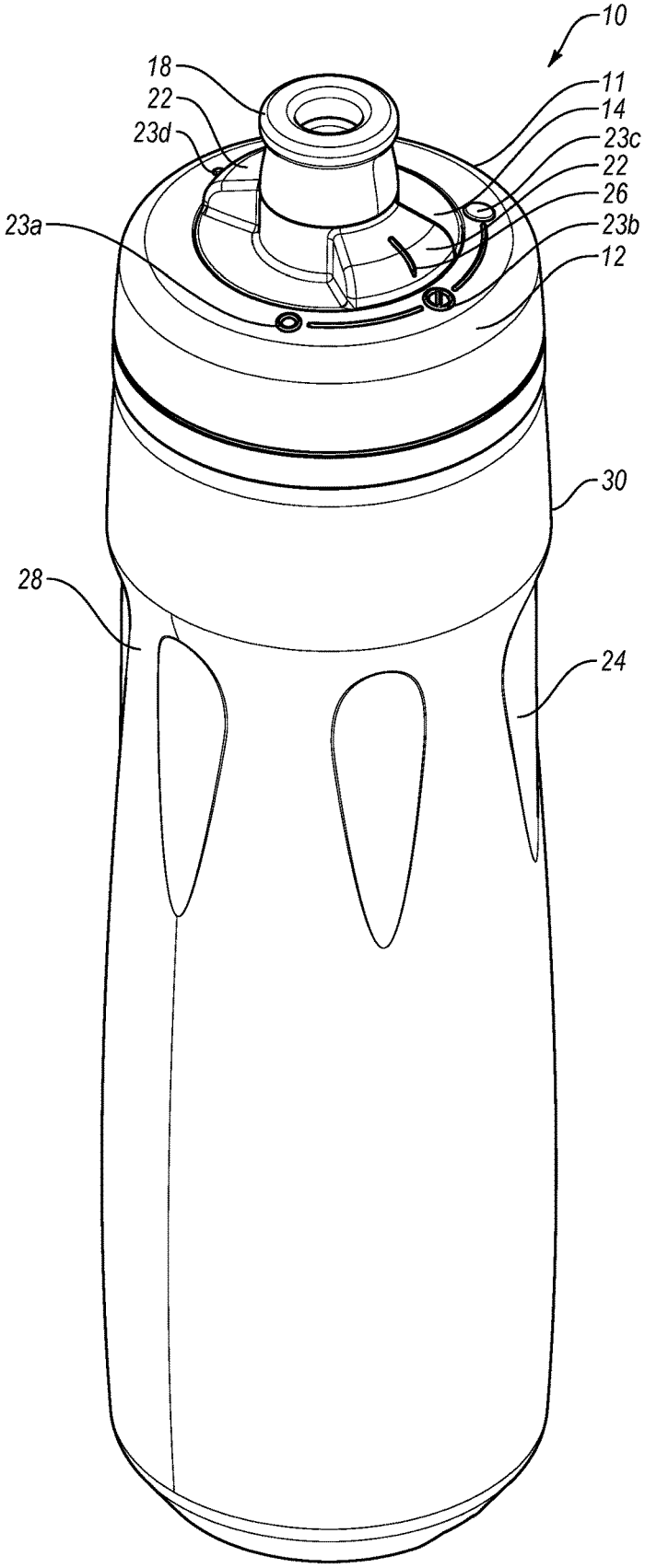
FIG. 1 is a perspective view of an example container according to one or more aspects of the subject technology.
Figure 2A:
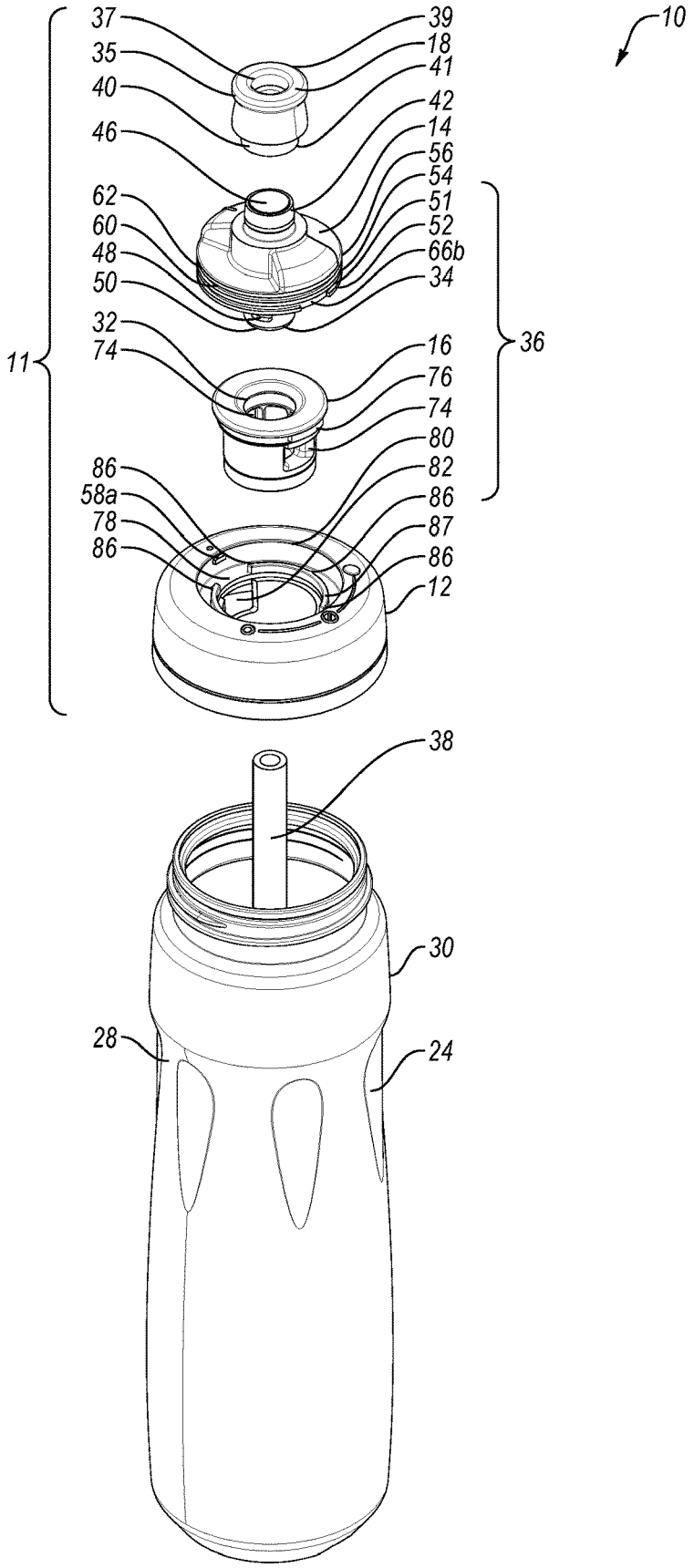
FIG. 2A is an exploded view of the container of FIG. 1 from a perspective.
Figure 2B:
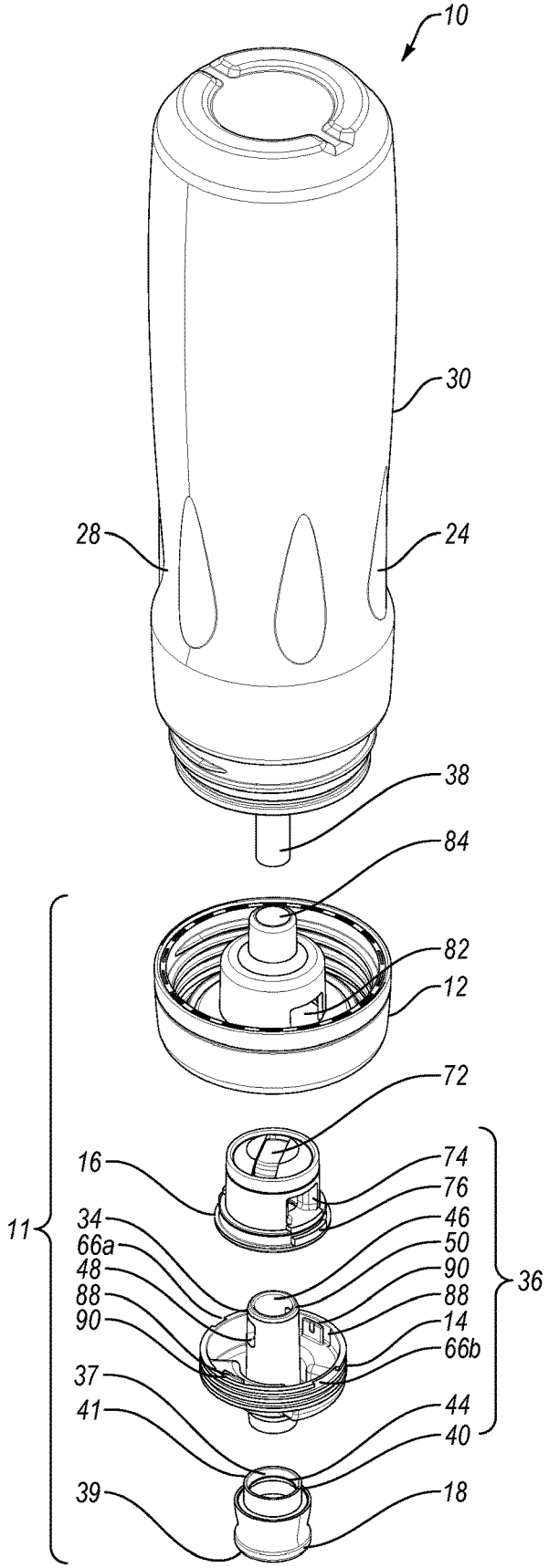
FIG. 2B is an exploded view of the container of FIG. 1 from another perspective.

FIG. 1 is a perspective view of an exemplifying embodiment of a liquid-dispensing container 10 that has a first configuration in which the container can dispense liquid through a straw, and a second configuration in which the container 10 can dispense liquid both without using the straw and without removing the straw from the container 10. Therefore, the container 10 can be used in multiple modes, and may allow liquid to be easily and conveniently stored, transported and consumed. FIG. 2A illustrates an exploded view of the container 10 of FIG. 1 from a first perspective, and FIG. 2B illustrates another exploded view of the container 10 of FIG. 1 from a second perspective. As used herein, the term "dispense" may include allowing fluid to be removed or released from a container under the influence of external force(s) and/or action(s), e.g., suction through a straw or squeezing of the container.

As illustrated for example in FIGS. 1, 2A and 2B, the container 10 may include a vessel 30 and a lid 11. The lid 11 may include a lid body 12, a valve assembly 36 and a nozzle 18. As shown in FIG. 1, the lid body 12 may be coupled to the vessel 30. As used herein, the term coupled may include a direct or indirect coupling of one feature or component to another.

The vessel 30 may include a bottle, jar, cup, or other structure capable of holding liquid. The vessel 30 may be sized and shaped to allow the container 10 to be used in connection with various supportive or stabilizing devices, such as bicycle water-bottle cages, cup holders, and the like. As shown in the accompanying figures, the vessel 30 may have a generally cylindrical configuration and the top of the container may be narrowed or tapered. In some embodiments, the vessel 30 may have a non-cylindrical configuration, and/or may not be narrowed or tapered at the top. The vessel 30 may include a recessed portion 28, such as groove or channel, to facilitate holding the container 10. If desired, the vessel 30 may include one or more gripping portions 24, which may also facilitate holding the container 10. The gripping portions 24 may be partially or entirely disposed in the recessed portion 28, or they may not overlap. The gripping portions 24 may be any suitable combination of protrusions, flanges, projections, shelfs, shoulders, ridges, bumps, recesses, indentations, textured surfaces, grooves, and the like. The gripping and recessed portions 24, 28 may help a user grip the container 10. The gripping and recessed portions 24, 28 may facilitate attachment of the lid 11 to and/or removal of it from the vessel 30. The gripping and recessed portions 24, 28 may facilitate assembly and/or disassembly of the components of the lid 11.

The vessel can be made of metal, glass, plastic, ceramic, or other materials, or combinations thereof. In some embodiments, the vessel may be at least partially constructed of a readily deformable and/or squeezable material, such as certain plastics or other materials or combinations thereof. For example, the vessel may be constructed from a material that allows the vessel to be squeezed and then resiliently return to at least generally the same shape and configuration as it had prior to the squeezing. The vessel may have an opening sufficiently large to allow the container to be easily filled, cleaned, and/or washed. One of ordinary skill in the art will appreciate, after reviewing this disclosure, that the vessel could have shapes, sizes, configurations and/or arrangements different than that of the illustrated vessel 30, depending, for example, upon the intended use of the container.

Turning to the lid 11, the valve assembly 36 may include a selector 14 and a valve body 16 (see, e.g., FIGS. 2A and 2B). Advantageously, the valve assembly 36 may increase the potential uses and functionality of the container. The valve assembly 36 may help control the flow of fluid through the lid 11, e.g., from the container 10. For example, a position of the selector 14 in the valve assembly 36 may determine whether fluid can flow from the container 10 via the nozzle 18, whether fluid flows through a straw 38 or through a different pathway, and/or whether fluid flow is restricted. In some embodiments, operation of the valve assembly 36 may not only determine whether fluid may flow in or out of the container 10 through it, but also through which of multiple potential, available pathways the fluid may flow. For example, the valve assembly may include a selector 14 with a first open position, which may allow the contents to be discharged by sucking through the straw and/or squeezing the container so that fluids flow through the straw, and a second open position, which may allow the contents to be discharged by inverting and/or squeezing the container.

The nozzle 18, the lid body 12, or both, can be integrally formed with the valve assembly 36 in some embodiments. The nozzle, selector, and valve body may be coupled or joined by, for example, fitting, snapping, threading, connecting, attaching, or fastening.

The valve body 16 can seal directly against the selector 14, or a separate seal can be used between the valve body 16 and the selector 14. Seals between the valve body 16 and the selector 14 are further described in conjunction with FIGS. 4C, 4D, 4E and 4F. A straw 38 may be coupled to the lid body 12 (see, e.g., FIGS. 2A and 2B), to the valve body 16, or to the selector 14. The straw 38 may allow the contents of the container 10 to be sipped or sucked through the straw 38. The straw 38 may also allow a user to drink from the container 10 at least while the container 10 is in a generally upright or vertical orientation. For example, in at least one example embodiment, the generally vertical orientation may include whenever the container 10 is within a 90° angle of vertical. The straw 38 may allow the user to drink from the container 10 when the container 10 is disposed between a generally upright to a generally or nearly horizontal orientation. In another example embodiment, the user may drink from the straw 38 when an upper end of the straw 38 is disposed above the lower end of the straw 38. For example, lower end of the straw 38 may be disposed at least proximate the lower inner surface of the vessel 30 and the upper end of the straw 38 may be disposed at least proximate an opening in the lid 11, lid body 12, or valve assembly 36. The user may easily drink through the straw 38 when the container 10 is positioned such that the upper end of the straw 38, which may be located at least proximate the valve assembly 36, is above the lower end of the straw 38. Further, the lower end of the straw 38 may be at least partially submerged by a liquid. In some embodiments, the ability to drink through the straw may depend on a fluid level within the vessel. In some instances, the user may be able to drink through the straw when a container is oriented such that an end of the straw disposed at or near the lid is below an opposing end of the straw.

The straw 38 may include a lower end that is spaced apart from the lower end of the vessel 30. For example, the straw 38 could extend along a portion, a minority, a majority, or an entire length of the vessel 30.

The selector 14 may be coupled to the lid body 12. The nozzle 18 may be coupled to the selector 14. The valve body 16 may be coupled to the selector 14 and the lid body 12. The lid body 12, the selector 14, the valve body 16 and the nozzle 18 may be assembled and arranged to allow fluid to flow from the container 10. For example, the lid body 12, the selector 14, the valve body 16 and the nozzle 18 may include one or more openings that may be at least partially aligned to allow fluid to flow from the container 10.

The selector 14 may be coupled to or include a conduit 46. In some embodiments, the conduit 46 may be removably coupled to the selector 14. The conduit 46 may be at least partially disposed within an elongate body 34. The conduit 46 may extend through the selector 14. For example, the conduit 46 may extend from an annular flange 42 of the selector 14 and through the elongate body 34 such that the conduit 46 forms an opening, interior passage, or channel through which fluid may flow within and through the selector 14. The conduit 46 may be hollow to allow fluid to flow through the interior passage of the conduit 46. In addition, fluid may flow into the conduit 46 through one or more openings 48, which may be formed in a sidewall of the elongate body 34, and/or an end 50 of the conduit. Thus, fluid may enter the conduit 46 through one or more openings 48 and/or the end 50 of the conduit 46. The openings may be formed so that they are surrounded entirely by material of the sidewall of the elongate body 34, or may be bounded on fewer than all sides by the sidewall. Fluid from the vessel 30 may exit the conduit 46 an end, which may be at or near the annular flange 42, if present.

The selector 14 and the valve body 16 may be coupled so that in at least one or more coupled arrangements, fluid can pass from the vessel 30 to the conduit 46. The selector 14 and the valve body 16 may be connected by friction, interference fit, snap fit, or a combination thereof. The selector 14 and the valve body 16 may be connected by other suitable means and these components may be selectively connected for purposes such as assembly and/or cleaning. For example, in some embodiments, the selector 14 and the valve body 16 may be held together, partially or entirely, by connection between the selector 14 and the lid body 12. The selector 14 may engage with the valve body 16 via one or more seals 100, as further described below.

Figure 6:
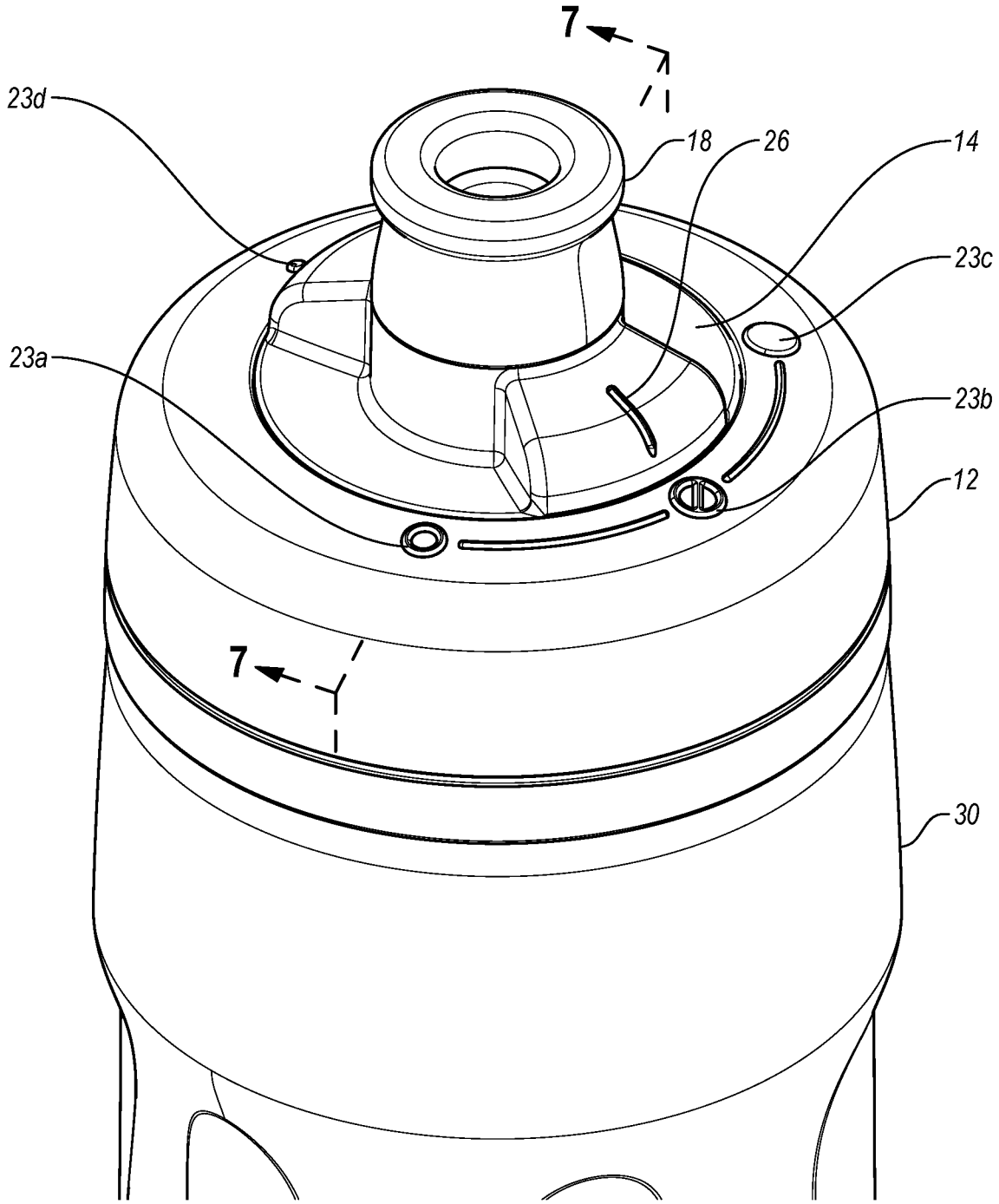
FIG. 6 is a partial, perspective view of the container shown in FIG. 2, illustrating the selector in a closed position.
Figure 7:
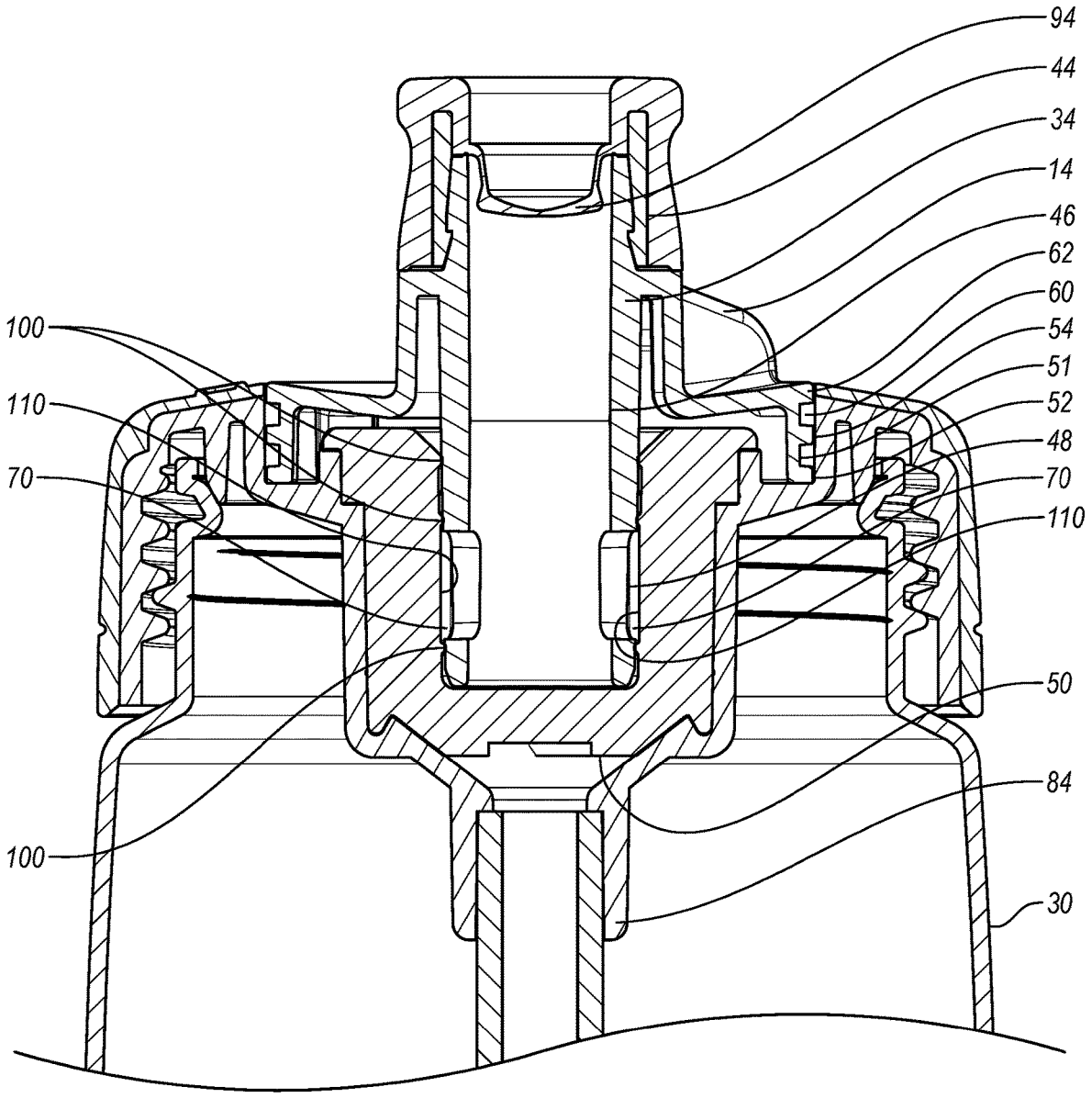
FIG. 7 is an enlarged, partial cutaway side view of the container shown in FIG. 6, illustrating the selector in the closed position.

The valve body 16 may have an opening 32 sized and shaped to receive the conduit 46 of the selector 14, and may include at least one interior sidewall 70. A passage may extend into the valve body 16 from the opening 32, and may have a substantially cylindrical shape, which may have circular cross-sectional shape. The opening 32 may be shaped (e.g., circular) and sized (e.g., having a diameter) to receive the conduit 46 and/or elongate body 34. The valve body may include one or more interior sidewalls 70 that impede or prevent fluid flow through the one or more openings 48 when the one or more openings 48 are positioned in the valve body 16 and the valve assembly is in a closed arrangement. The shape and size of the opening 32 may confirm closely to, and in some embodiments may seal against, the conduit 46 and/or elongate body 34. In at least some embodiments, the elongate body 34 may be in contact with one or more seals 100 at the interior sidewall 70, such that fluid flow may be impeded or prevented by the one or more seals. For example, as shown in FIGS. 6 and 7, when the selector 14 is in a closed position, the position of the conduit 46 relative to the at least one seal 100 may impede or prevent fluid from flowing into the selector 14. Impeding, preventing or restricting fluid flow may completely prevent all fluid flow, or may prevent some or most fluid flow. For example, some fluid leakage may occur due to manufacturing tolerances or material imperfections.

One or more ends of the valve body 16 may include one or more ports, such as a set or sets of ports that are sized and shaped to facilitate fluid flow. For example, the valve body 16 may include a set of straw ports 72 that are sized and shaped to permit fluid flow from the straw 38 when the selector 14 is in a position that corresponds to a straw mode. Further details of the straw mode configuration are described in conjunction with FIGS. 8 and 9. Similarly, the valve body 16 may include a set of pour ports 74 that are shaped to permit fluid flow from the vessel 30 when the selector 14 is in a position that corresponds to a pour mode. Further details of the pour mode configuration are described in conjunction with FIGS. 10 and 11. The one or more ports may be fluidly isolated from each other at the valve body 16, such as through the use of one or more seals 100, as further described in conjunction with FIGS. 4C, 4D, 4E and 4F.

The selector 14 may be movable relative to the valve body 16 while the lid 11 is assembled. The elongate body 34 and/or the conduit 46 of the selector 14 may be shaped (e.g., having a circular cross section in a plane normal to an axis of rotation) to rotate within the opening 32 of the valve body 16. For example, the elongate body 34 and/or the conduit 46 of the selector 14 may rotate within the opening 32 of the valve body 16 to various positions, as described herein.

The selector 14 may be moved between any number of different positions while assembled with the lid body 12 and/or the valve body 16. A force may be applied to move the selector 14 between the various positions. For example, a force, such as a rotational force, or other intentional act may be used to move the selector 14 between a first open position and a second open position. Similarly, a force, such as a rotational force, or other intentional act may be used to move the valve between one or more open positions and one or more closed positions. In some embodiments wherein a force or intentional act is required to move the valve between one or more positons, this may help prevent unintended opening of the valve. Selection between multiple open positions may facilitate faster and/or more convenient consumption of liquids from the container. Thus, increased flexibility may be provided in that the user may drink from the container by sucking or squeezing through a straw when the valve assembly is in the first open position, or by "squirting" or "pouring" when the valve assembly is in the second open position.

In some embodiments, the selector 14 may be moved (e.g., rotated), relative to the lid body 12 and/or the valve body 16, between first, second, third and fourth positions. Although the selector 14 illustrated in FIGS. 1, 2A, and 2B is movable between four positions, the selector can be moved between fewer or more than four positions in some embodiments. Each of the positions may correspond to a respective mode of the container 10 and/or selector 14. For instance, a first position of the selector 14 may correspond to a closed mode in which fluid is blocked by the selector 14 from entering or exiting the vessel 30. A second position of the selector 14 may correspond to a straw mode in which fluid may pass to and from the vessel 30 through a conduit, pathway or the like, such as a straw 38. A third position of the selector 14 may correspond to a pour mode in which fluid may pass to and from the vessel 30 through the selector 14 without passing through the straw 38. A fourth position of the selector 14 may correspond to a detachment mode in which the valve assembly 36 (e.g., the selector 14 and valve body 16) may be decoupled from the lid body 12. Quick and easy detachability of the valve assembly 36 may facilitate cleaning, manufacturing and/or assembly.

Figure 8:
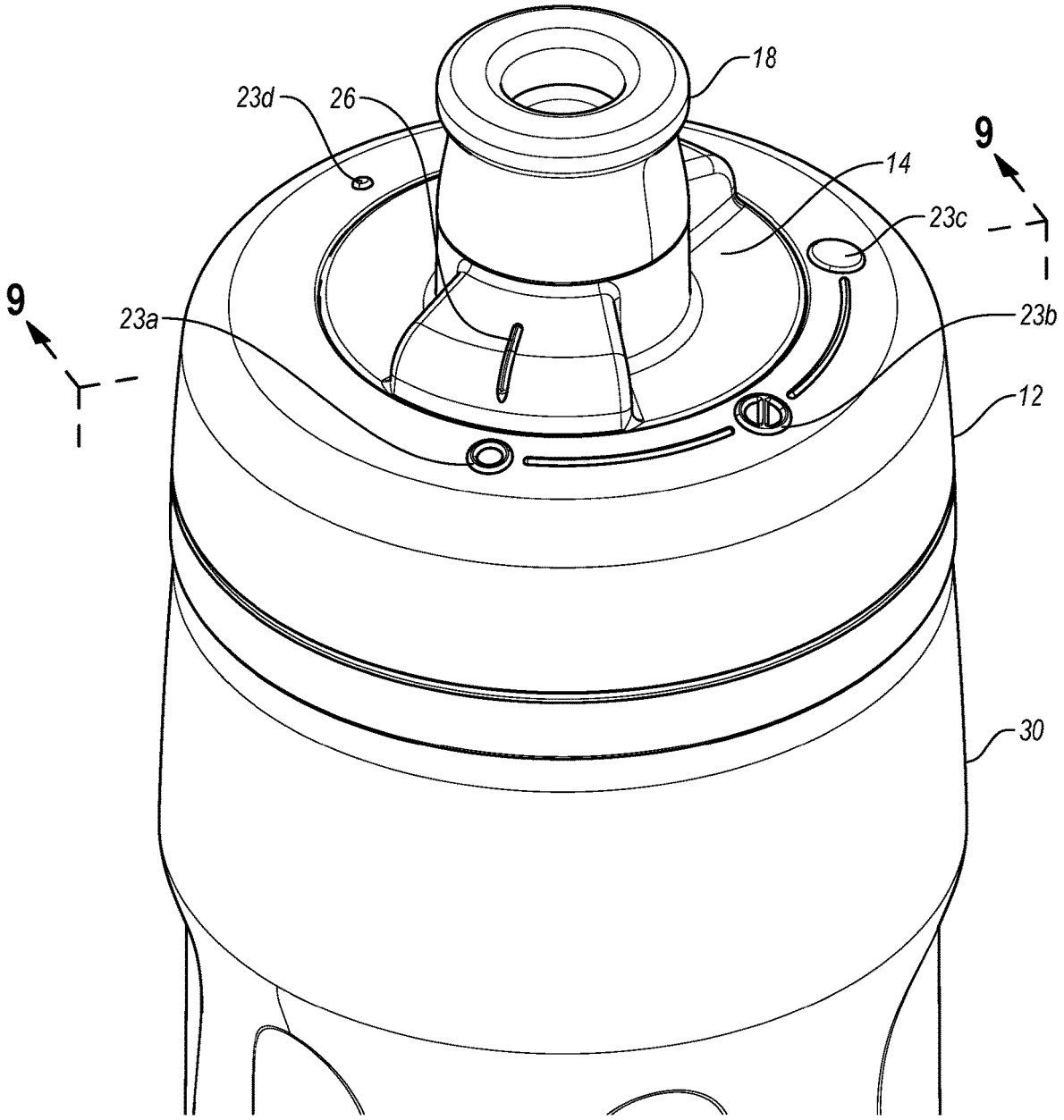
FIG. 8 is a partial, perspective view of the container shown in FIG. 2, illustrating the selector in a first open position.
Figure 9:
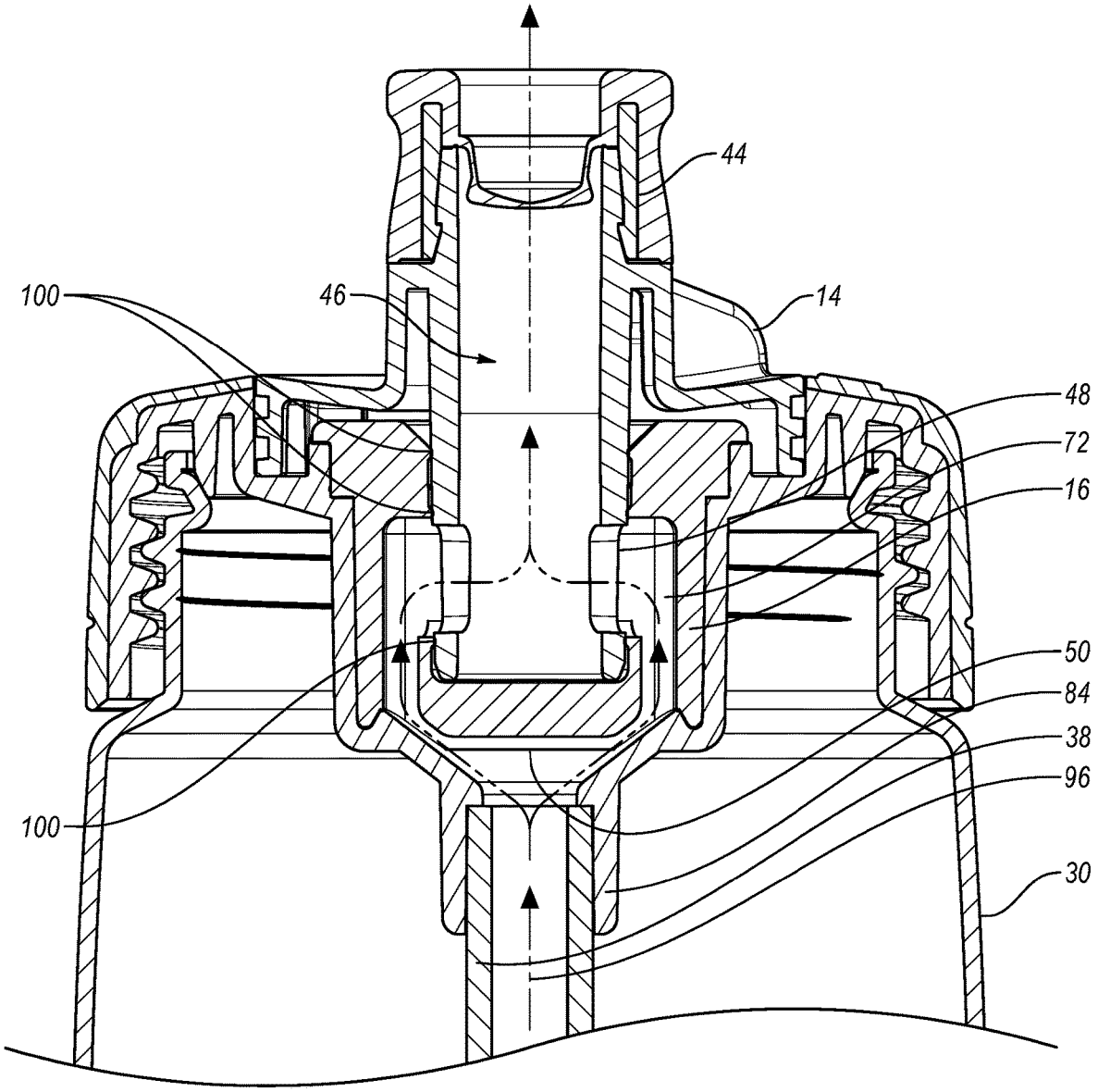
FIG. 9 is an enlarged, partial cutaway side view of the container shown in FIG. 8, illustrating the selector in the first open position.
Figure 10:
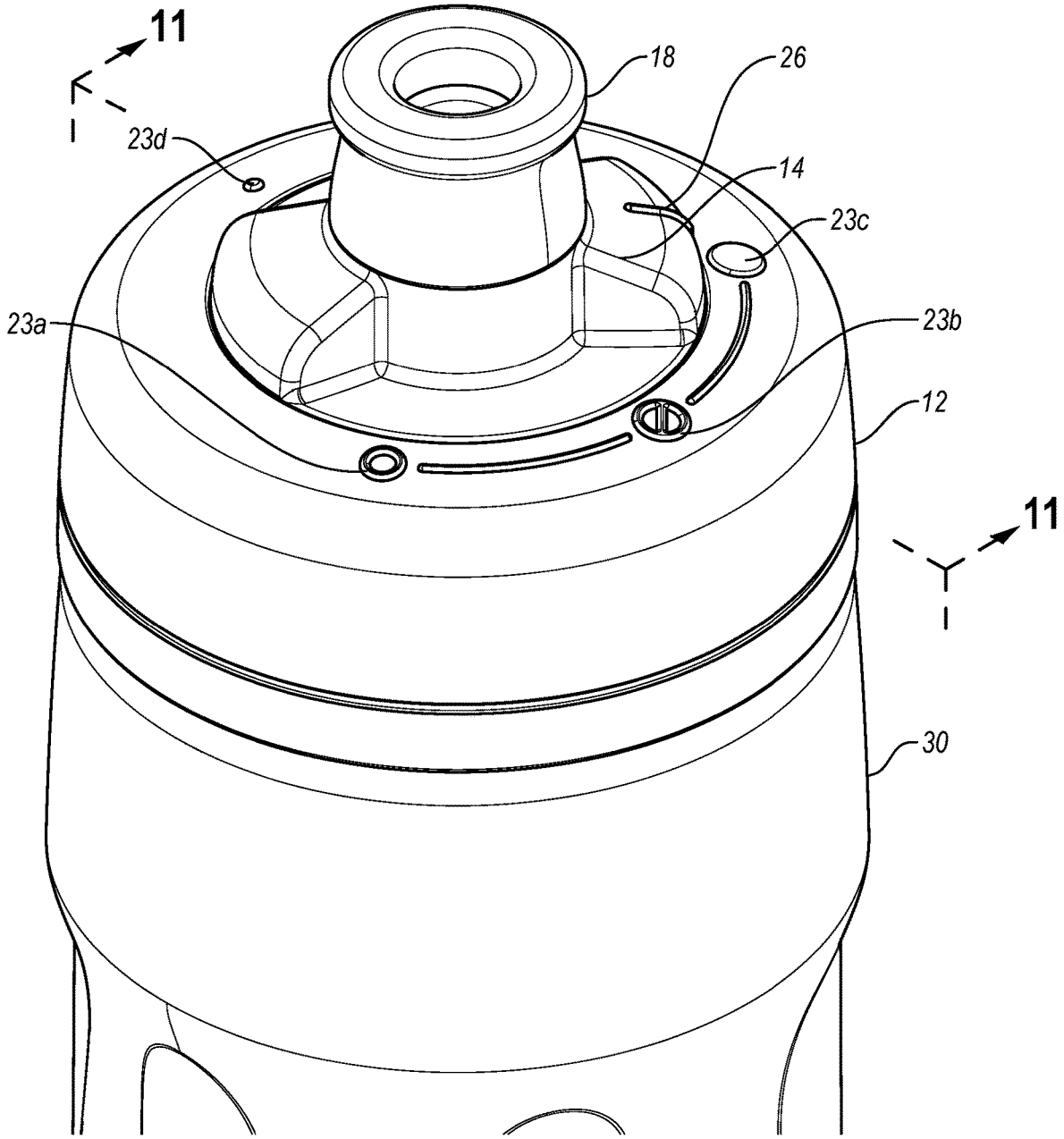
FIG. 10 is a partial, perspective view of the container shown in FIG. 2, illustrating the selector in a second open position.
Figure 11:
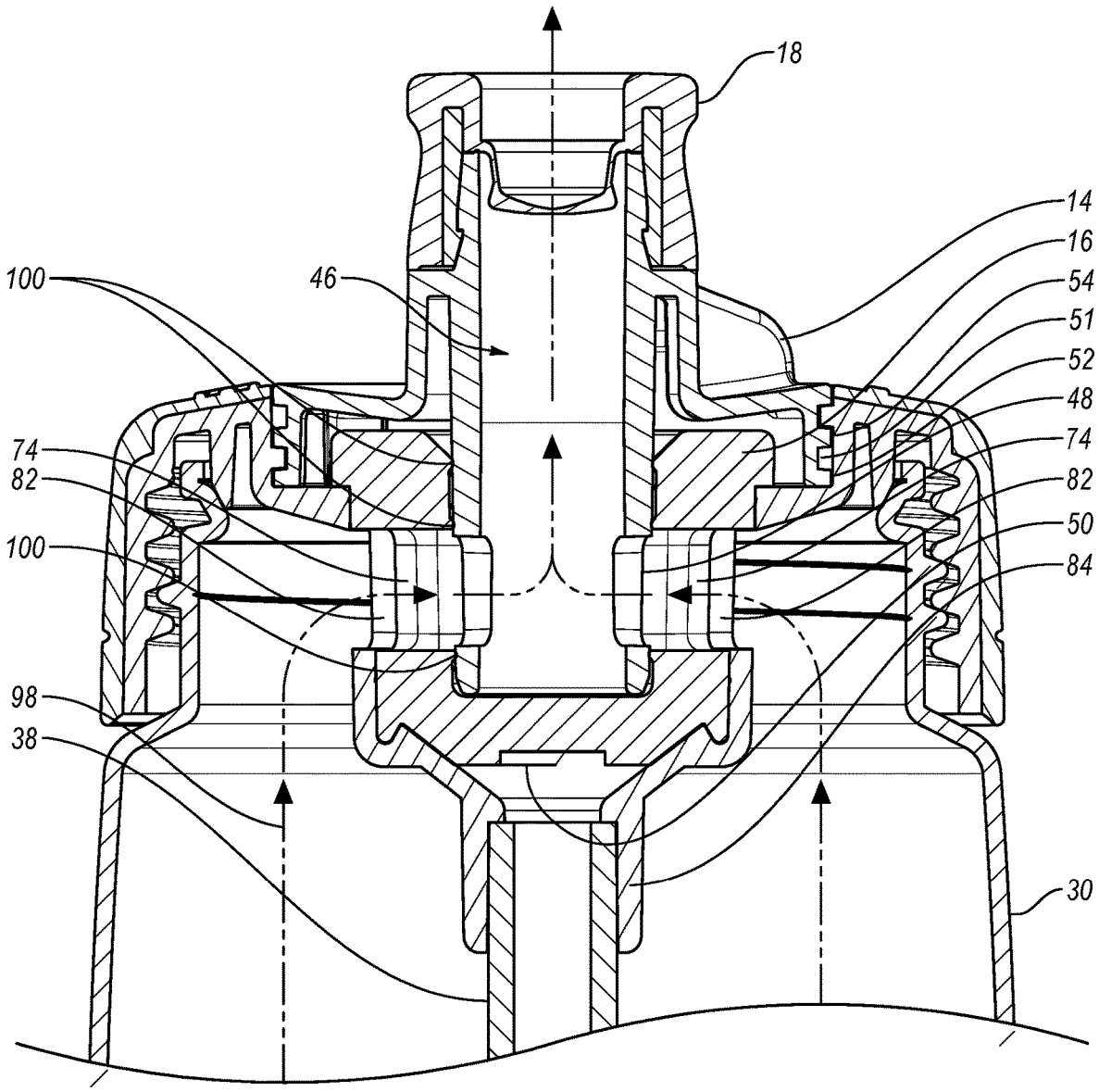
FIG. 11 is an enlarged, partial cutaway side view of the container shown in FIG. 10, illustrating the selector in the second open position.
Figure 12:
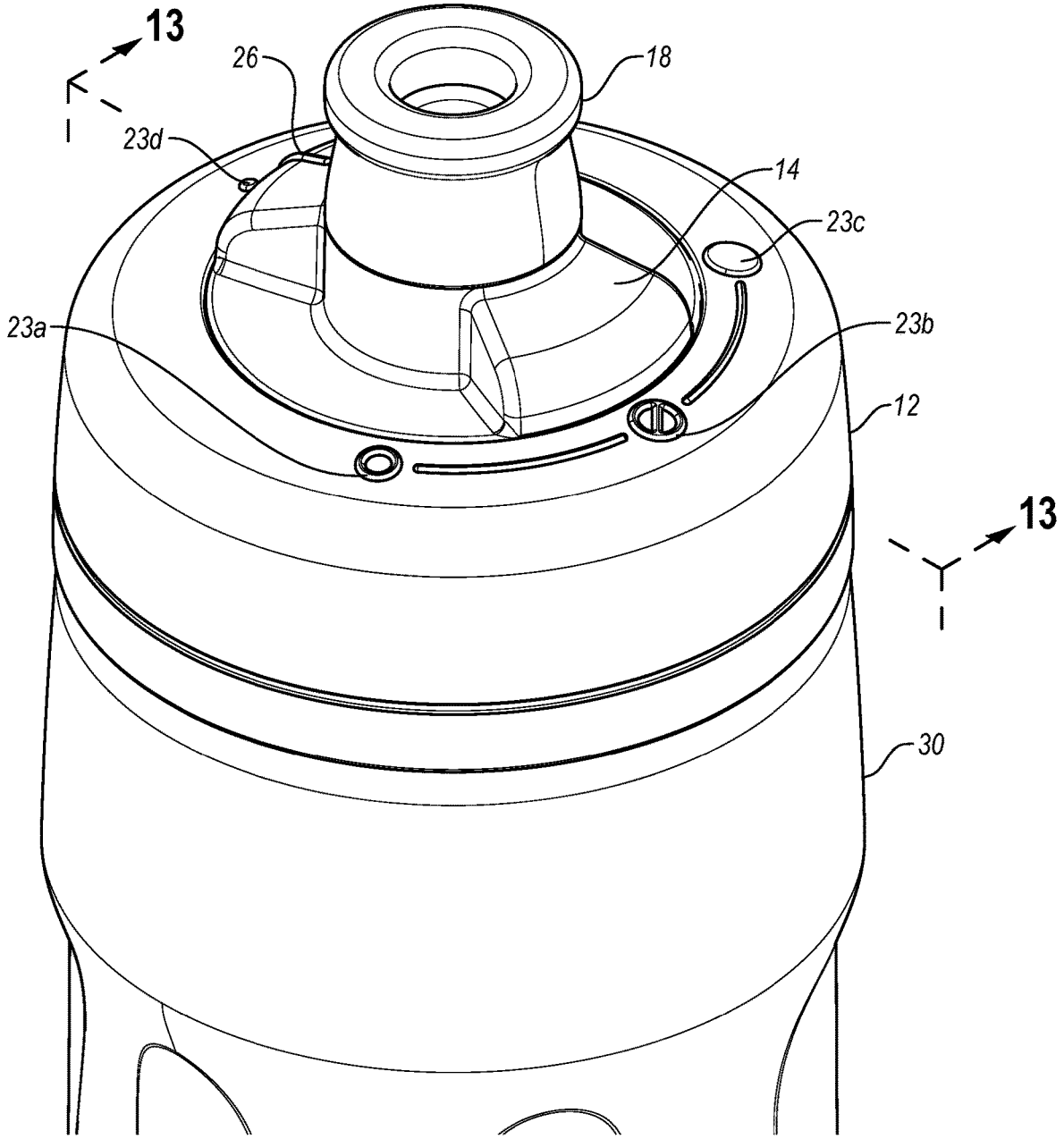
FIG. 12 is a partial, perspective view of the container shown in FIG. 2, illustrating the selector in a detachment position.
Figure 13:
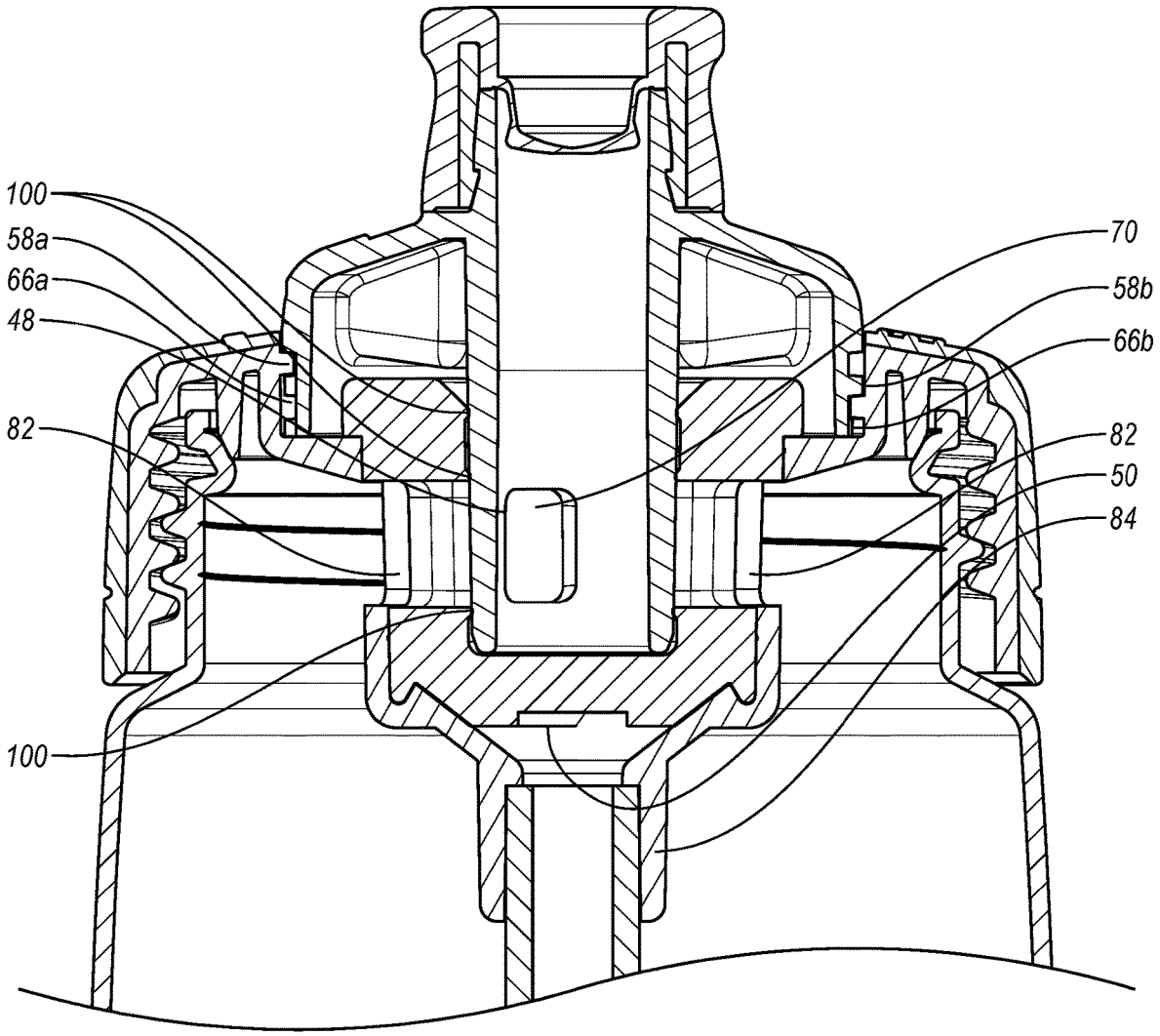
FIG. 13 is an enlarged, partial cutaway side view of the container shown in FIG. 12, illustrating the valve assembly in the detachment position.

The various positions of the selector 14 and the corresponding modes are further described with respect to FIGS. 6-13. For example, FIGS. 6 and 7 illustrate the selector 14 in the closed mode, FIGS. 8 and 9 illustrate the selector 14 in the straw mode, FIGS. 10 and 11 illustrate the selector 14 in the pour mode, and FIGS. 12 and 13 illustrate the selector 14 in the detachment mode. Although four positions have been described above, any number of positions are contemplated and may be in any order (e.g., an order in which the positions are reached during movement of the selector in a single direction). Further, the container 10 may include any number of openings and positions other than those illustrated and may be for other purposes than those described, such as for dispensing liquid from a second vessel or selecting between multiple portions of a single vessel.

The selector 14 may include one or more engagement portions 22 (see, e.g., FIG. 1) that a user may push, pull, grasp, and/or grip to facilitate moving the selector 14 between the positions of the selector 14. Exemplifying engagement portions 22 include handles, flanges, protrusions, shelves, shoulders, ridges, bumps, recesses, indentations, textured surfaces, and grooves.

As illustrated in FIG. 1, the lid body 12 may include one or more position indicators 23*a*, 23*b*, 23*c*, and 23*d*. The selector 14 may include indicia, such as a position indicator 26 or position marker that may point to one of the position indicators 23*a*, 23*b*, 23*c*, and 23*d* when the selector 14 rotated to a corresponding position. For example, when in the straw mode, the position indicator 26 may point to a straw mode position indicator 23*a*; when in the closed mode, the position indicator 26 may point to a closed mode position indicator 23*b*; when in the pour mode, the position indicator 26 may point to a pour mode position indicator 23*c*; and when in the detachment mode, the position indicator 26 may point to a detachment mode position indicator 23*d*.

The valve assembly 36 may be coupled to the lid body 12 by one or more engaging and receiving portions. For example, the valve assembly 36 may be coupled to the lid body 12 by using at least one key and groove configurations, which may allow rotational movement while limiting or restricting translational movement of the selector 14 in some positions. For example, the selector 14 may include one or more receiving portions, such as a first groove 51, and one or more engaging portions, such as a lower protuberance 52 and an intermediate protuberance 54. The lower protuberance 52 and the intermediate protuberance 54 may be substantially parallel, substantially concentric, and may be formed on and extend along (e.g., circumferentially) an outer surface 56 of the selector 14. The lower protuberance 52 and the intermediate protuberance 54 may extend to an extent that permits translational movement only when the selector 14 is in a detachment position. The lid body 12 may include one or more engaging portions, such as key 58*b*, that are sized and shaped to fit within the first groove 51, which may be a void disposed between the lower protuberance 52 and the intermediate protuberance 54. As the selector 14 and the lid body 12 move relative to each other, the one or more keys 58*b* may slide along a circular path defined by the first groove 51. In at least one embodiment, a second groove 60 may be formed between the intermediate protuberance 54 and an upper protuberance 62. A second key 58*a* may be sized and shaped to fit within the second groove 60, which may be a void disposed between the intermediate protuberance 54 and the upper protuberance 62.

To couple or decouple the valve assembly 36 to or from the lid body 12, the selector 14 may include one or more openings, such as passages or passthroughs 66*a*, 66*b*, in one or more of the protuberances 52, 54, and 62. For example, in a single groove configuration, the lower protuberance 52 may include a first passthrough 66*b* that is sufficiently large to permit a key 58*b* on the lid body 12 to be removed from (and inserted into) the first groove 51. Further, the lid body 12 may include any number of keys 58*b* that may be shaped to fit within the first groove 51. If desired, multiple keys 58*a*, 58*b* may be spaced evenly about the lid body 12. For example, a two-key system may include two keys that are spaced substantially 180 degrees apart. In a three-key system, for example, three keys may be spaced substantially 120 degrees apart. After reviewing this disclosure, one of ordinary skill in the art will appreciate that any suitable number of keys, grooves, passthroughs, and the like may be utilized depending, for example, upon the intended use of the container 10.

Another embodiment may include a dual groove configuration. In a dual groove configuration, the lower protuberance 52 and the intermediate protuberance 54 may include a first passthrough 66*a* that is sufficiently large to permit a first key 58*a* on the lid body 12 to be removed from (and inserted into) the second groove 60. Similarly, the lower protuberance 52 may include a second passthrough 66*b* that is sufficiently large to permit a second key 58*b* on the lid body 12 to be removed from (and inserted into) the first groove 51. The first key 58*a* may be smaller in length than the second key 58*b*, and the first passthrough 66*a* may be smaller in length than the second passthrough 66*b*, for example as illustrated in FIGS. 3A, 3B, 5A, and 5B. The first key 58*a* and the second key 58*b*, however, may be any shape or size and may be the same shape and size or a different shape and size. Similarly, the first passthrough 66*a* and the second passthrough 66*b* may be any shape or size and may be the same shape and size or a different shape and size. The first key 58*a* and the first passthrough 66*a* may have different sizes than the second key 58*b* and the second passthrough 66*b*, so that at least one of the first key and the second key cannot fit in both the first passthrough and the second passthrough.

The valve body 16 and the lid body 12 may be coupled to allow fluid to flow from the vessel 30 to the valve body 16 in at least the open mode(s) of the valve assembly 36. The valve body 16 may be received into a receptacle 80 of the lid body. In some embodiments, the valve body 16 may remain in a generally fixed position relative to the lid body 12 while the selector 14 is moved. Movement of the valve body 16 relative to the lid body 12 may be limited or restricted by a member such as a tab, protrusion, projection, fastener, and the like. For example, the valve body 16 may include at least one keying shoulder 76 that may fit within at least one seat 78 of the lid body 12 to limit or prevent rotation of the valve body 16. The keyed nature of the engagement between the at least one shoulder 76 and the at least one seat 78 may serve to limit or prevent rotational movement of the valve body 16 with respect to the lid body 12. The at least one shoulder 76 and the at least one seat 78 may be connected by friction, interference fit, snap fit, or a combination thereof. After reviewing this disclosure, it will be appreciated that the various components of the valve assembly 36 may be coupled and connected to each other and/or to the lid body 12 using other appropriate structures, connectors and the like. For example, the valve body 16 may be coupled to the lid body 12 by one or more threads. In some embodiments, the valve body and the lid body may be formed as a single monolithic component, which may form a port of the valve assembly 36.

The lid body 12 may be connected to the vessel 30 by any type of suitable connection, such as a threaded connection, for example. The lid may be coupled or connected to the container by a connection that allows the lid to be quickly secured to the container. The lid may include a gasket, washer, sealing ring or liner to help seal the opening of the container. These and other components of the container 10 may also be integrally formed as part of a unitary, one-piece structure if desired.

The receptacle 80 of the lid body 12 may be sized and shaped to receive some or all of the valve assembly 36. In some example embodiments, at least a portion of the receptacle 80 and at least a portion of the valve assembly 36 may have complementary shapes sized such that they are in contact with each other across the complementary shapes when assembled. For example, the receptacle may comprise a generally cylindrical portion and at least the portion of the valve assembly 36 (e.g., the valve body 16) may comprise a cylindrical portion of sized to engage the generally cylindrical portion of the receptacle 80 when the valve assembly 36 and the lid body 12 are assembled.

The lid body 12 may include a set of pour openings 82 that are sized, shaped, and positioned to allow fluid from the vessel 30 and into the valve body 16. The pour openings may have a size equal to or smaller or larger than the pour ports 74 of the valve body 16. The pour openings 82 of the lid body 12 can have the same shape as the pour ports 74 of the valve body 16. The pour openings 82 of the lid body 12 can be positioned such that when assembled with the valve assembly 36, the pour openings 82 are in constant or selective fluid communication with the pour ports 74 of the valve body. When the selector 14 is in a position that corresponds to the pour mode, the openings 48 of the conduit 46, the pour ports 74 of the valve body, and the pour openings 82 of the lid body 12 can be aligned an in fluid communication with each other such that fluid may flow from the vessel 30 and out of the container 10 by way of the nozzle 18.

Figure 5A:
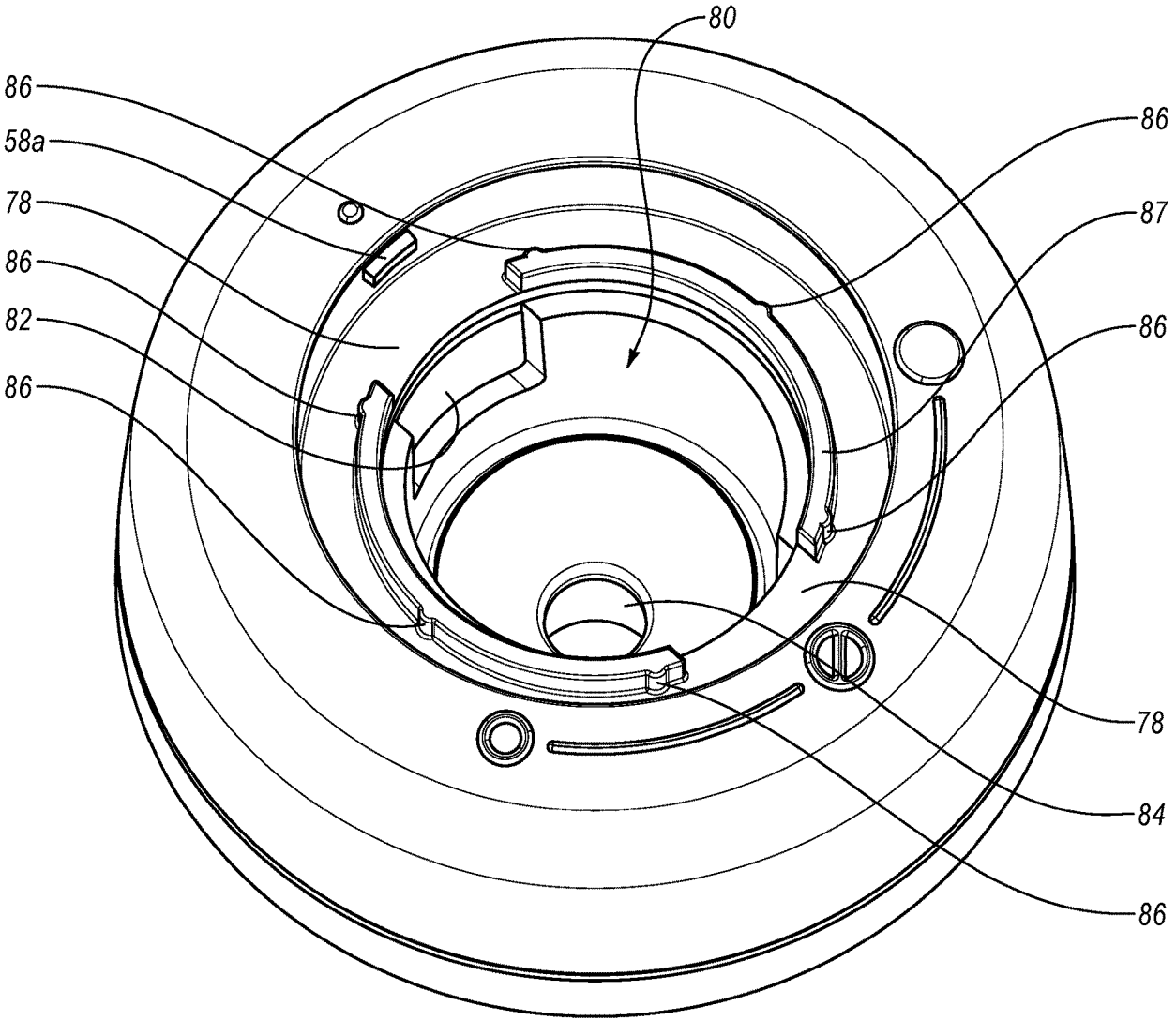
FIGS. 5A, 5B and 5C are enlarged perspective views of a lid body of the container shown in FIGS. 2A and 2B.
Figure 5B:
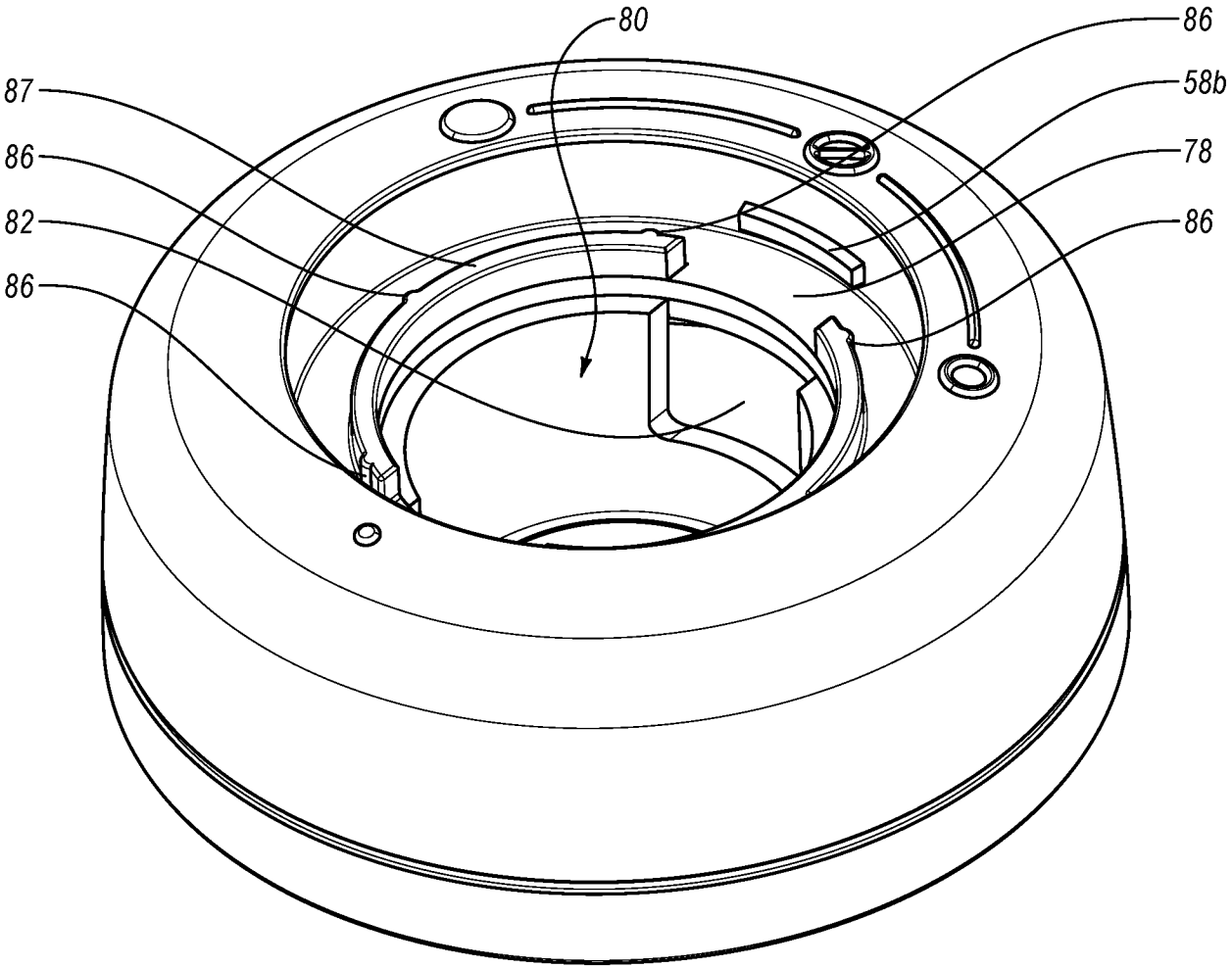
Figure 5C:
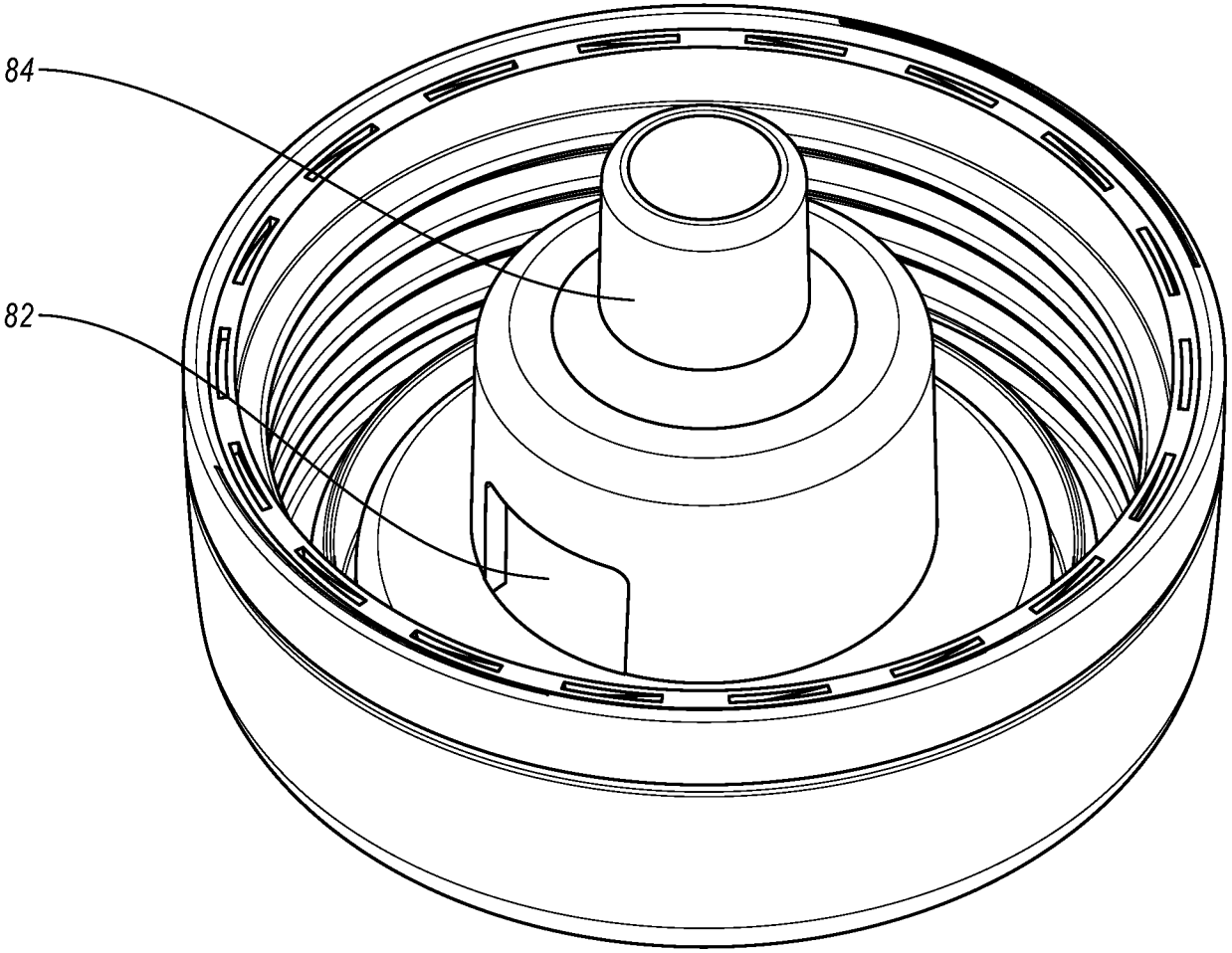

The lid body 12 may include a straw connector 84, as illustrated, for example, in FIGS. 2B, 5A, and 5C. The straw connector can be configured to support the straw 38 so that fluid can flow from the vessel 30 via the straw 38, through the straw connector 84 and into the valve body 16. The straw connector 84 may be permanently or removably coupled to the lid body. In some embodiments, the straw connector 84 may be formed integrally with the lid body 12. The straw connector may be sized and shaped to retain the straw 38. For example, the straw 38 and the straw connector 84 may be connected by a friction, interference, tension, compression, snap fit connection, or a combination thereof. Additionally or alternatively, the straw 38 and the straw connector 84 may be connected by other suitable means, and these components may be selectively connected for purposes such as assembly and/or cleaning. When the selector 14 is in a position that corresponds to the straw mode, the openings 48 of the conduit 46, the straw ports 72 of the valve body, and the straw 38 supported by the straw connector 84 can be in fluid communication with each other such that the fluid may flow from the vessel 30 and out of the container 10 by way of the nozzle 18.

The lid may include an air valve and the air valve may be a one-way valve designed to decrease or relieve the pressure that can be created in a tightly sealed container when sucking through a straw. The air valve, for example, may be created by an access hole. The access hole could be disposed in the lid and the access hole could be a slit valve in the lid gasket. In view of this disclosure, one of ordinary skill in the art will appreciate that the lid could be larger or smaller, and the lid could include any suitable number of openings or apertures of varying sizes, depending, for example, upon the intended use of the container.

Figure 3B:
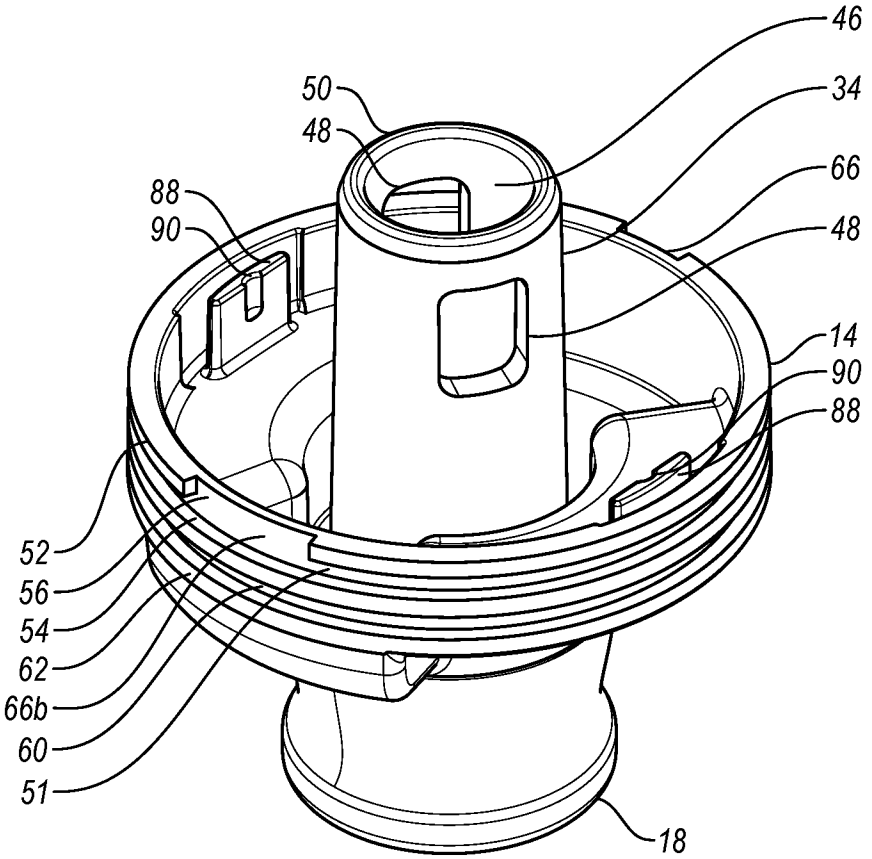
FIGS. 3A and 3B are enlarged perspective views of a selector and a nozzle of the container shown in FIGS. 2A and 2B.
Figure 3A:
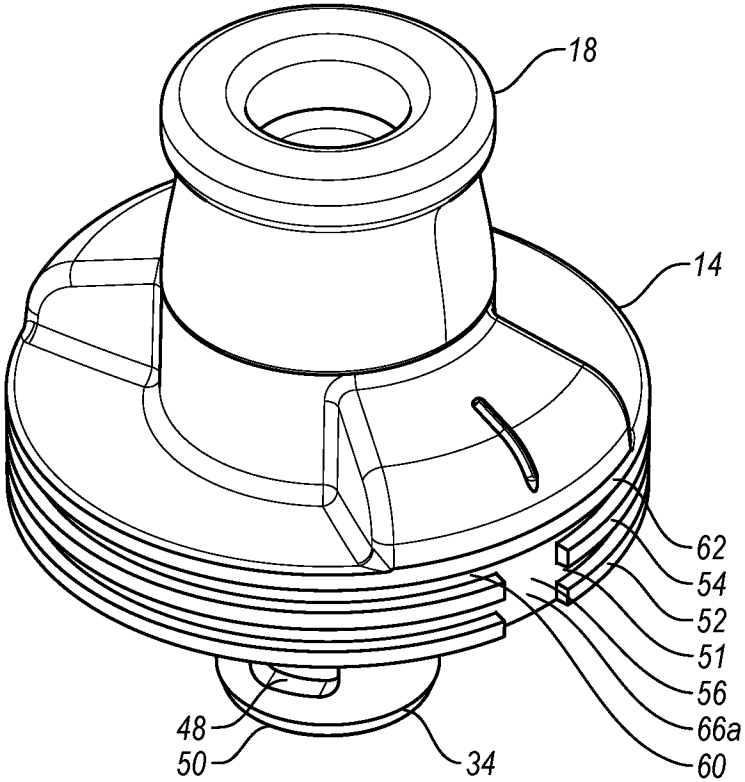

To facilitate and/or to provide user feedback for positioning the selector 14, the selector 14 and at least one of the lid body 12 or the valve body may include one or more notches 90 and detents 86 to resist rotation of the selector 14 at one or more defined positions, such as those disclosed herein. The detents 86 may include a protrusion sized and shaped to cooperate with the notches 86. Coupling of the notches 90 with the detents 86 (e.g., protrusions) may resist movement of the selector 14 from positions where at least one notch and at least one detent are coupled. As illustrated in FIGS. 5A and 5B, the lid body 12 may include six detents 86 that may correspond to three different positions. The detents 86 may be spaced by any suitable linear, arcuate (e.g., circumferential), or angular distance. Although FIGS. 5A and 5B show the six detents 86 spaced equally with the detents 86 positioned on a raised surface 87, the detents 86 may be unequally spaced in some embodiments and the raised surface may not be required. The selector 14 may include one or more spring-actuated levers 88 and/or notches 90 that are sized and configured to mate with one or more detents 86, for example, as illustrated in FIGS. 3A and 3B. The selector 14 may include two spring-actuated levers 88, each with one or more notches 90, but any number of spring-actuated levers 88 and notches 90 are contemplated. In some embodiments, the notches and/or the detents can be arranged in diametrically opposed pairs. In some embodiments, the lid body 12 can comprise one or more notches 90 (e.g., on the raised surface 87), and the selector 14 can comprises one or more detents 86 (e.g., positioned on the spring-actuated levers 88), as illustrated, for example, in FIGS. 15A, 15B, 16A and 16B.

The nozzle 18 may include a distal end 35 and a proximal end 40 (see FIG. 2A). The distal end 35 of the nozzle 18 may include an outwardly facing opening 37 through which fluid may flow. The opening 37 may be surrounded by a radially outwardly extending annular flange 39.

The nozzle 18 can comprise a diaphragm valve 94 (see FIG. 7). The diaphragm valve can open under pressure to allow fluid to flow through the diaphragm valve 94. For example, internal pressure or external suction may cause the diaphragm valve 94 to open enough to permit fluid to pass through.

The proximal end 40 of the nozzle 18 may include a receiving portion 41 that is sized and shaped to attach to the selector 14. For example, the receiving portion 41 of the nozzle 18 may be shaped to slide over or otherwise attach to the annular flange 42 of the selector 14. In at least one embodiment, the nozzle 18 may include a base cylindrical body 44 (see e.g., FIGS. 2B and 7). The base cylindrical body 44 may be more rigid than another portion, e.g., a more distal portion, of the nozzle. The base cylindrical body 44 and the other, less-rigid portion may comprise the same or different materials. One of the materials can be molded over or into the other. For example, the base cylindrical body 44 may be over-molded by a relatively more flexible material, such as silicone, for example. At least a portion of the base cylindrical body 44, such as an internally facing surface of the base cylindrical body 44, may be exposed. The exposed portion of the base cylindrical body 44 may include one or more features that are sized and shaped to interlock with one or more complementary features of the annular flange 42 of the selector 14. For example, the exposed portion of the base cylindrical body 44 may include an internally-facing interlock and the annular flange 42 of the selector 14 may include an externally-facing interlock. The interlocks can include flanges, protrusions, shelves, shoulders, ridges, bumps, recesses, indentations, and grooves, for example.

The vessel 30, the lid body 12, the selector 14, the valve body 16, the nozzle 18, and the straw 38 may be constructed from various materials with desired properties, such as, for example, plastic, glass, metal, composite and the like. The vessel 30, the lid body 12, the selector 14, the valve body 16, the nozzle 18, and/or the straw 38 may be constructed partially or entirely of transparent or translucent materials, which may allow the user to see the type and amount of fluids in the vessel 30. Additionally or alternatively, the vessel 30, the lid body 12, the selector 14, the valve body 16, the nozzle 18, and the straw 38 may be constructed from durable, long-lasting materials that allow them to be reused and/or recycled. The lid body 12 and the selector 14 may be constructed, for example, from materials such as high-density polyethylene (HDPE), a copolyester polymer, Tritan™, polypropylene, or other materials with similar or different properties and/or characteristics. The vessel 30 may comprise plastic, glass, metal, composite and the like. The vessel 30 may comprise plastic materials such as HDPE, LDPE, copolyester polymer, Tritan™, or polypropylene, for example. In some embodiments, the vessel 30 can comprise a material sufficiently flexible to allow the vessel 30 to be squeezed or deformed, and then resiliently return to its original position. For example, the vessel 30 may be constructed from HDPE, low-density polyethylene (LDPE), polypropylene, or other materials with similar or different properties and/or characteristics. The valve body 16, the nozzle 18 and the straw 38 may be constructed from silicone, HDPE, LDPE, copolyester polymer, Tritan™, polypropylene, or other materials with similar or different properties and/or characteristics.

As illustrated in FIGS. 3A and 3B, the selector 14 and the nozzle 18 may be connected. For example, the selector 14 and the nozzle 18 may be coupled by interlocking features, as discussed above. In some embodiments, the nozzle 18 may be constructed from plastic and it may be over-molded onto at least a portion of the selector 14. In particular, the nozzle 18 may be over-molded onto an upper portion of the selector 14. FIGS. 3A and 3B may more clearly illustrate various features of the selector 14 and the nozzle 18, as described with respect to FIGS. 1, 2A and 2B.

Figure 4B:
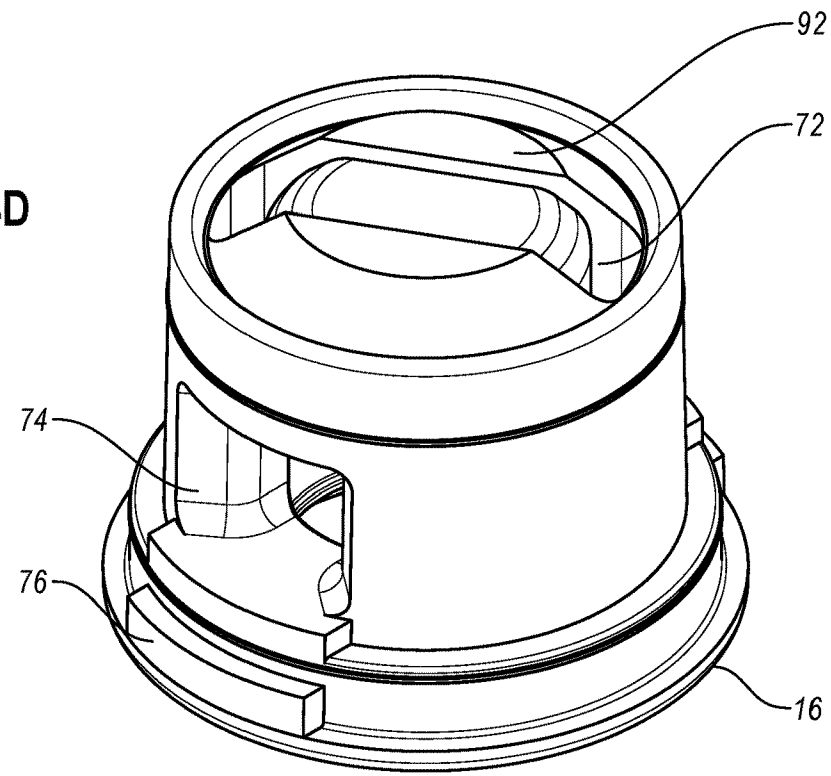
FIGS. 4A and 4B are enlarged perspective views of a valve body of the container shown in FIGS. 2A and 2B.
Figure 4A:
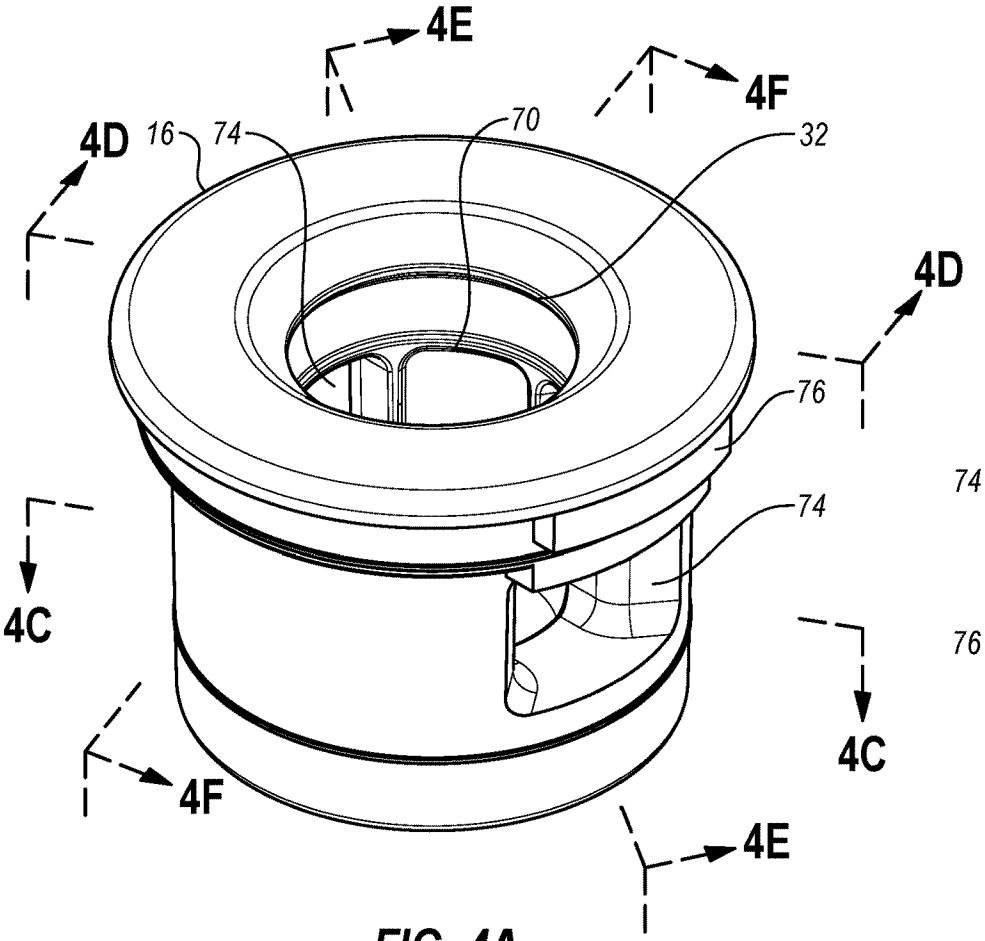

FIGS. 4A-4F illustrate additional views of the valve body 16 shown in FIGS. 1, 2A and 2B. As illustrated in FIGS. 4A and 4B, for example, a bottom end 92 of the valve body 16 may be shaped to substantially match or mate with the geometry of the straw connector 84. For example, the bottom end 92 of the valve body 16 may be rounded or chamfered.

FIGS. 4C-4F are cross-sectional views of the valve body 16 shown in FIGS. 4A and 4B, and illustrate an exemplifying embodiment that includes two open positions (e.g., pour, straw) and one closed position. One or more seals 100 may be sized and shaped to impede or prevent fluid flow between fluid dispensing paths and/or leaking from the container. The seal 100 may include a flange, protrusion, shelf, shoulder, ridge, bump, etc. The seal 100 may comprise any material including a same material as the valve body 16 or a different material. The seal may be assembled with the valve body 16 or formed integrally with the valve body 16. The seal 100 may be any shape, such as circular, oval, annular, rectangular, square, etc. In at some embodiments, the seal 100 may be a flexible material that may be attached to the valve body 16. For example, the seal 100 may comprise an O-ring. One or more seals 100 may engage the elongate body 34 to form a fluid-tight connection.

Figure 4D:
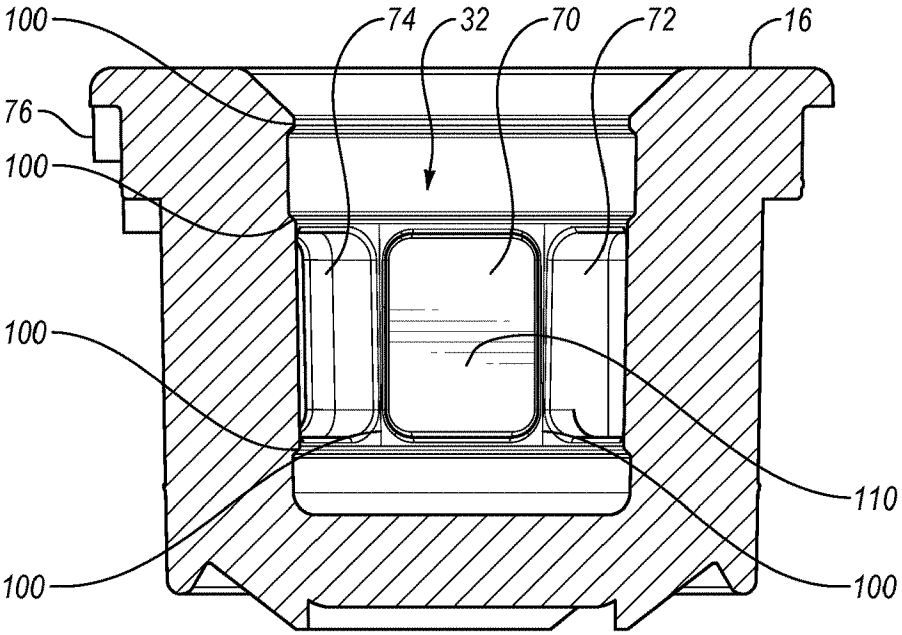
FIGS. 4C, 4D, 4E and 4F are cross-sectional views of the valve body shown in FIGS. 4A and 4B.
Figure 4C:
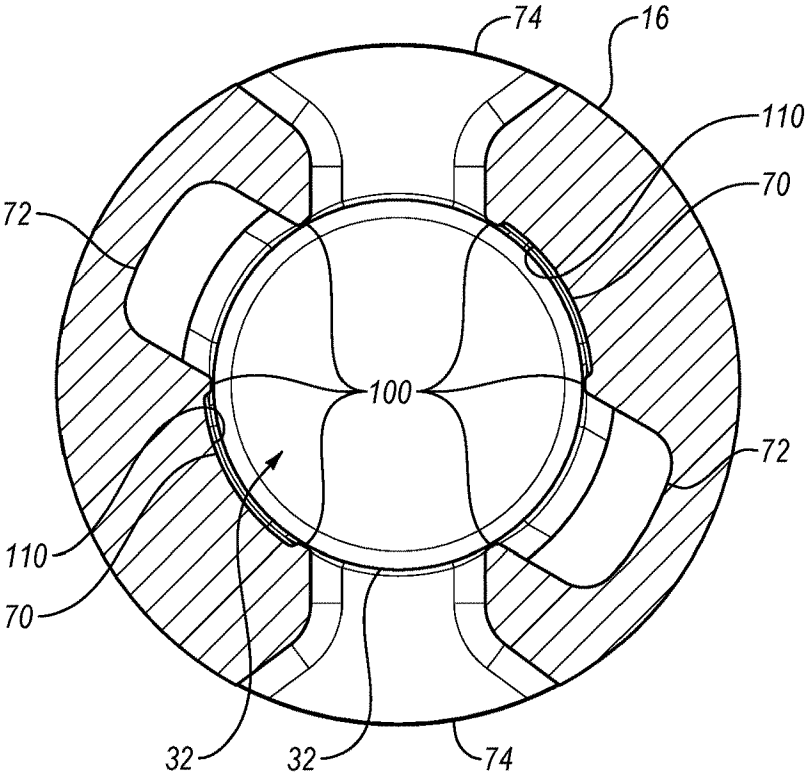
Figure 4F:
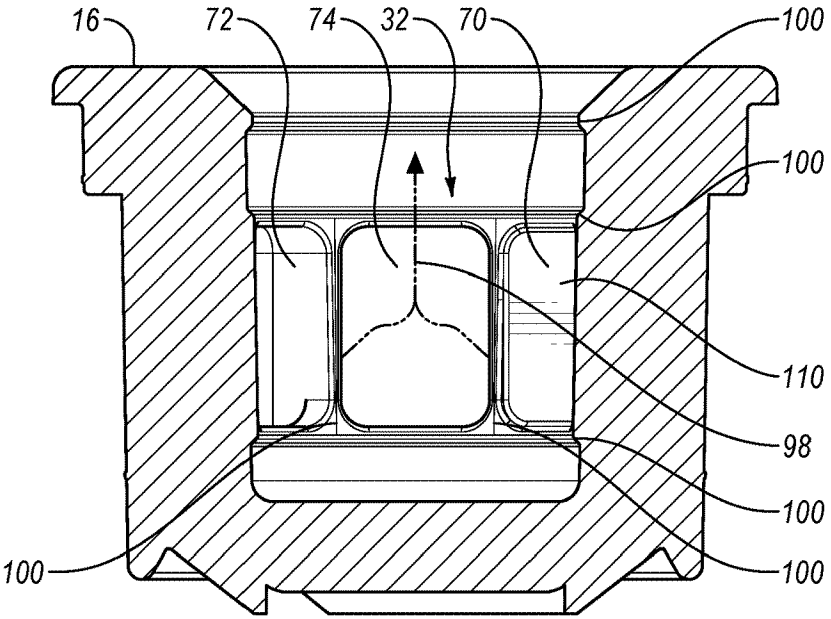
Figure 4E:
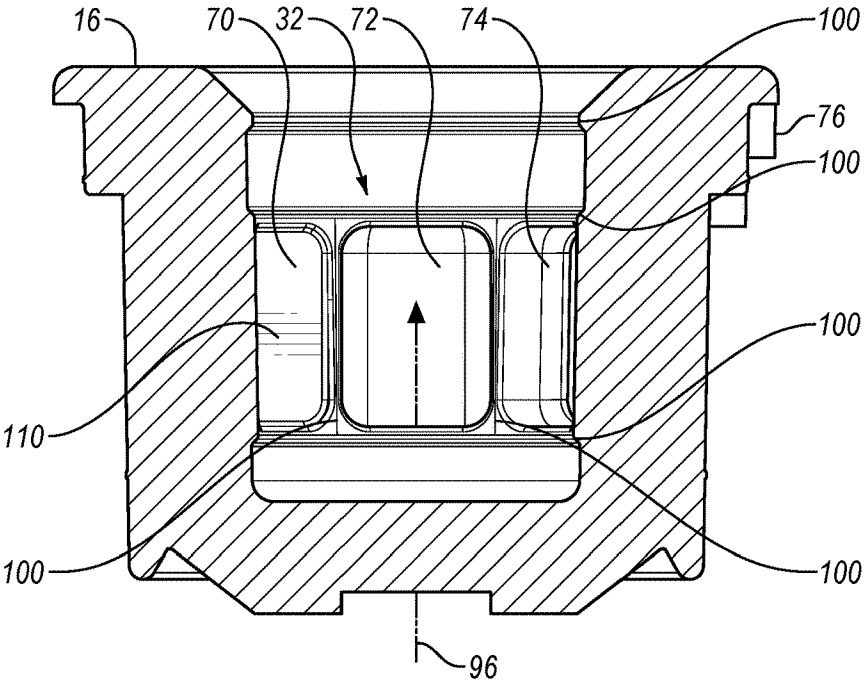

One or more seals 100 may be positioned to impede or prevent fluid flow between some or all of the straw port(s) 72, the pour port(s) 74, and a portion 110 of the interior sidewall 70 that blocks fluid flow in a closed arrangement of the valve assembly 36. For example, one or more seals may partially or completely surround each of the straw port(s) 72, the pour port(s) 74, and the portion 110 of the interior sidewall 70 that blocks fluid flow in a closed arrangement of the valve assembly 36. The one or more seals 100 may extend radially inwardly from the interior sidewall 70 of the valve body 16, and may extend circumferentially with respect to the opening 32, longitudinally (e.g., vertically, as illustrated in FIGS. 4D-4F), or a combination thereof. For example, in the embodiment illustrated in FIGS. 4C-4F, two seals 100 extend annularly within the opening 32 above the interior sidewall 70, the straw port 72 and the pour port 74, one seal 100 extends annularly below the interior sidewall 70, the straw port 72 and the pour port 74, and six seals 100 extend longitudinally and positioned to separate the straw ports 72, the pour ports 74, and the portions 110 of the interior sidewall 70 that block fluid flow in a closed arrangement of the valve assembly 36. In at least one embodiment, the seal 100 may be substantially the same shape as any of the portion 110 of the interior sidewall 70, the straw port 72 and the pour port 74. For example, when the straw port 72 is substantially a rectangle with rounded corners, the seal 100 may likewise be a slightly larger rectangle with rounded corners to create a seal around the straw port 72. Some embodiments may have fewer or more seals than are illustrated in the accompanying figures. Any of the components described here may include one or more seal features disposed therebetween. The seal features may include a gasket, washer, sealing ring, diaphragm, annular seal, and/or liner, to help create a seal between any components described herein. The seal features may create a liquid and/or air-tight seal, which may prevent the contents of the container from leaking or spilling.

FIGS. 6-13 illustrate various perspective views and corresponding cross-sectional views of various positions of the selector 14 and the corresponding modes. When the container 10 is used, the selector 14 may be moved between open and closed positions, including multiple open positions and multiple closed positions, if present. The selector 14 illustrated in FIGS. 6-13 may be moved between a closed position (e.g., closed mode) illustrated in FIGS. 6 and 7; a first open position (e.g., straw mode) illustrated in FIGS. 8 and 9; a second open position (e.g., pour mode) illustrated in FIGS. 10 and 11; and a detachment position (e.g., detachment mode) illustrated in FIGS. 12 and 13. Advantageously, when the selector 14 is moved, the conduit 46 coupled to the selector 14 may also move and the positioning of the selector 14 and conduit 46 may control fluid flow through the conduit 46 and valve body 16. That is, positioning of the selector 14 may determine whether or not fluid will flow from the valve body 16 into the conduit 46. The positioning of the selector 14 may also control the pathway that fluid can flow into the conduit 46, and that may determine whether fluids can be sucked and/or squeezed through the straw 38 or whether fluids can be poured or squeezed out through the nozzle 18 when the container 10 is inverted.

In the closed position, the indicator 26 of the selector 14 may point to, be adjacent to, or be aligned with the position indicator 23*b* on the lid body 12, for example as illustrated in FIG. 6. While in the closed position, the position of the conduit 46 (e.g., of the openings 48) relative to the valve body 16 may impede or prevent fluid from entering the conduit 46 from the vessel 30, for example as illustrated in FIG. 6. The portion 110 of the sidewall 70, alone or in cooperation with one or more seals 100, may block fluid from passing from the vessel 30 into the conduit 46. In this configuration, fluid from the vessel 30 may enter the valve body 16 from the straw 38 or through the pour ports 74, but the fluid may not enter the conduit 46. A wall of the elongate body 34, alone or in cooperation with one or more seals 100, may impede or prevent fluid from moving from each of the straw port(s) 72 and the pour port(s) 74 of the valve body 16 into the conduit 46.

In the first open position (e.g., straw mode), the indicator 26 of the selector 14 may point to, be adjacent to, or be aligned with the position indicator 23*a* on the lid body 12, for example as illustrated in FIG. 8. While in the first open position, the conduit 46 receives fluid flow from the vessel 30 through the straw ports 72 of the valve body 16, for example as illustrated in FIG. 9. Fluid may flow through the openings 48, if present, from the straw ports into the conduit 46. The openings 48 may be substantially aligned with the straw ports 72, for example as illustrated in FIG. 9, when the selector 14 is in the first open position. Substantial alignment of the straw ports 72 and the openings 48 of the conduit 46 may include any alignment that permits fluid to flow from the straw 38 to the openings 48 via the straw ports 72. In some embodiments, the straw ports 72 and the openings 48 may be substantially the same shape. In some embodiments, when the straw ports 72 and the openings 48 of the conduit 46 are aligned, the cross-sectional area of the straw ports 72 may overlap the cross-sectional area of the openings 48 (e.g., as viewed in a direction of fluid flow). In some embodiments, the area of overlap may be at least five percent of the smaller of the cross-sectional areas. In some embodiments, the area of overlap may be at least fifty percent of the smaller of the cross-sectional areas. In some embodiments, the area of overlap may be at least eighty percent of the smaller of the cross-sectional areas. In some embodiments, the area of overlap may be at least ninety-five percent of the smaller of the cross-sectional areas. In some embodiments, when the straw ports 72 and the openings 48 of the conduit 46 are aligned, the larger of the cross-sectional areas may completely overlap the smaller of the cross-sectional areas. In some embodiments, the straw ports 72 and the openings 48 of the conduit 46 may not overlap when the straw ports 72 and the openings 48 of the conduit 46 are aligned.

Placing the selector 14 in the first open position may establish a fluid pathway that allows fluid to flow through the conduit 46 and/or the selector 14. In some embodiments, while the selector 14 is in the first open position, fluid may not flow from the vessel 30 into the conduit 46 without first passing through the straw 38. In the first open position, fluid may flow from the vessel 30, through the straw 38, through the straw ports 72, through the openings 48, if present, through the conduit 46 and out of the container 10 via the nozzle 18. A path 96 of an exemplifying fluid flow while the selector 14 is in the first open position 23*a* is illustrated in FIG. 9.

In the second open position (e.g., pour mode), the indicator 26 of the selector 14 may point to, be adjacent to, or be aligned with the position indicator 23*c* on the lid body 12, for example as illustrated in FIG. 10. While in the second open position, the conduit 46 receives fluid flow from the vessel through the pour ports 74 of the valve body 16, for example as illustrated in FIG. 9. Fluid may flow through the openings 48, if present, from the pour ports into the conduit 46. The openings 48 of the conduit 46 may be substantially aligned with the pour ports 74 of the valve body 16, for example as illustrated in FIG. 11, when the selector 14 is in the second open position.

Substantial alignment of the pour ports 74 and the openings 48 of the conduit 46 may include any alignment that permits fluid to flow from the pour ports 74 into the openings 48 without passing through the straw 38. In some embodiments, the pour ports 74 and the openings 48 may be substantially the same shape. In some embodiments, when the pour ports 74 and the openings 48 of the conduit 46 are aligned, the cross-sectional area of the pour ports 74 may overlap the cross-sectional area of the openings 48 (e.g., as viewed in a direction of fluid flow). In some embodiments, the area of overlap may be at least five percent of the smaller of the cross-sectional areas. In some embodiments, the area of overlap may be at least fifty percent of the smaller of the cross-sectional areas. In some embodiments, the area of overlap may be at least eighty percent of the smaller of the cross-sectional areas. In some embodiments, the area of overlap may be at least ninety-five percent of the smaller of the cross-sectional areas. In some embodiments, when the pour ports 74 and the openings 48 of the conduit 46 are aligned, the larger of the cross-sectional areas may completely overlap the smaller of the cross-sectional areas. In some embodiments, the pour ports 74 and the openings 48 of the conduit 46 may not overlap when the pour ports 74 and the openings 48 of the conduit 46 are aligned.

Placing the selector 14 in the second open position may establish a fluid pathway that allows fluid to flow through the conduit 46 and/or the selector 14. In some embodiments, while the selector 14 is in the second open position, fluid may not flow into the conduit 46 without passing through the pour ports 74. In the second open position, fluid may flow from the vessel 30, through the pour ports 74 of the valve body 16, through the openings 48 of the conduit 46, through the conduit 46 and out of the container 10 via the nozzle 18. A path 98 of an exemplifying fluid flow while the selector 14 is in the second open position 23*c* is illustrated in FIG. 11.

It should be understood that some or all of the components described herein may be in fluid communication with each other. For example, some or all of the components may be in fluid communication when the path 96 and/or the path 98 is established. Although the vessel 30, the straw 38, the valve body 16, the selector 14, and the nozzle 18 may be in fluid communication with other of them, fluid may travel in a path of least or shortest resistance. For example, fluid may travel along the path 98 while the selector 14 is in the second open position, and the fluid may travel along the path 96 while the selector 14 is in the first open position.

In the detachment position (e.g., detachment mode), the indicator 26 of the selector 14 may point to, be adjacent to, or be aligned with the position indicator 23*d* on the lid body 12, for example as illustrated in FIG. 12. While in the detachment position, the keys 58*a*, 58*b* on the lid body 12 may be substantially aligned with the passthroughs 66*a*, 66*b* of the selector 14 such that the valve assembly 36 may be attached to or detached from the lid body 12, for example as illustrated in FIG. 13. In some embodiments, the selected 14 can be detached only when the selector is in the detachment position.

When it is desired to use the container 10, the lid body 12 may be removed from the vessel 30, and the vessel 30 may be easily filled with fluids such as water, sports drinks, solutions, suspensions, and the like. The lid body 12 may then be connected to the vessel 30 by any type of suitable connection, such as a threaded connection, for example. When selector 14 is in the closed position, the valve assembly 36 impedes or prevents fluid from flowing therethrough. If a user desires to drink from the container 10 using the straw 38, the selector 14 may be moved into the first open position, and the user may suck on the nozzle which causes fluid to flow through a pathway through the straw 38 and the valve assembly 36, and may open the diaphragm valve 94, if present. In some embodiments, when the selector 14 is in the first open position, the container 10 may be squeezed to cause fluid to flow through the straw 38. If a user desires to dispense liquid from the container 10 without using the straw (e.g., by pouring or squeezing), the selector 14 may be moved into the second open position, and the fluid may be dispensed by inverting and/or squeezing the container 10. In some embodiments, when the selector 14 is in the second open position, fluid may flow out of the container 10 under the force of gravity. In some embodiments, while the selector 14 is in the second open position, fluid may be squirted out of the container 10. In some embodiments, the different pathways that can be established by rotating the selector 14 may allow the container 10 to be used in upright and inverted positions, and may allow the container 10 to be used both with a straw 38, and without the straw while the straw remains in place.

Figure 14A:
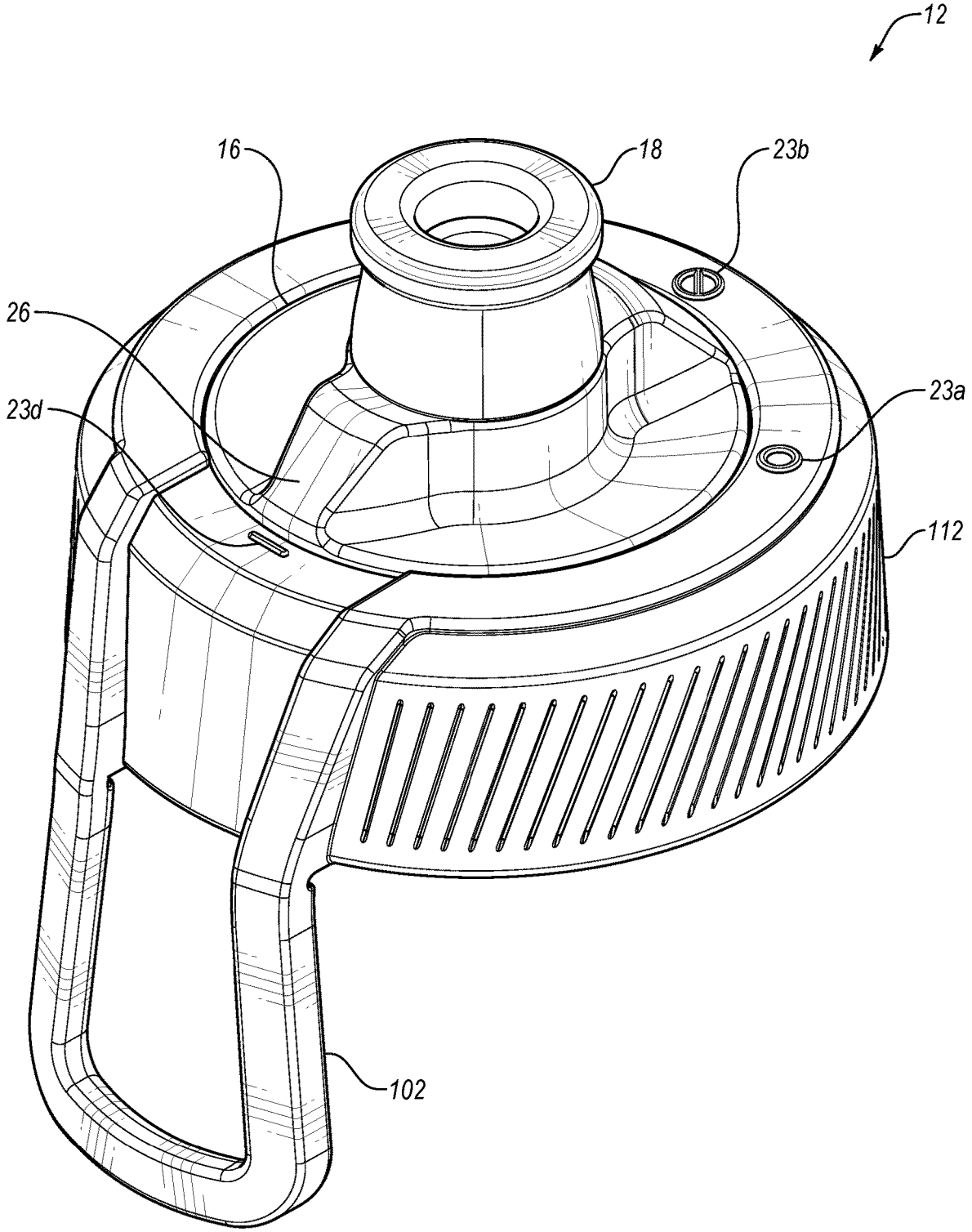
FIGS. 14A and 14B illustrate a lid body with a carrying member.
Figure 14B:
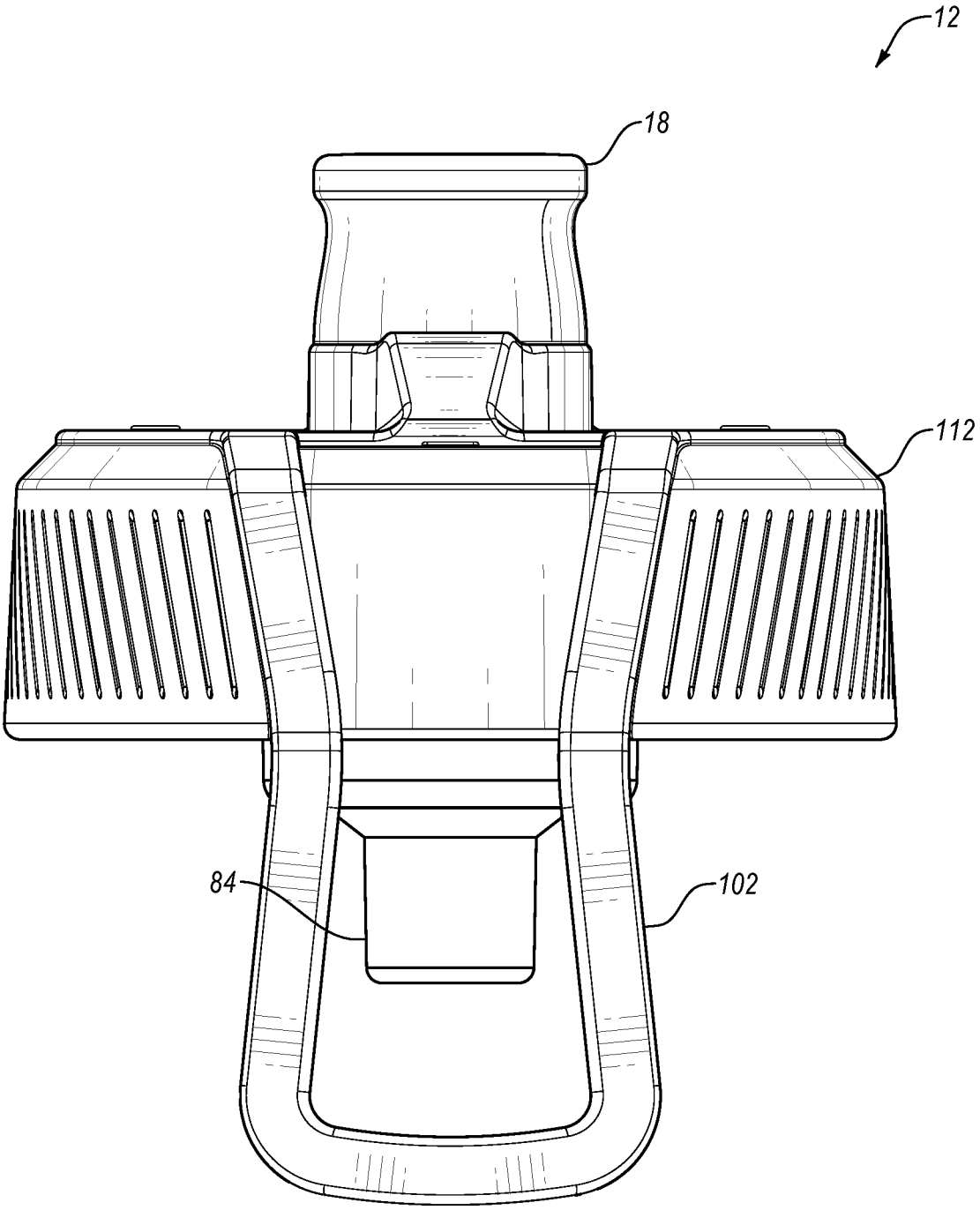
Figure 15A:
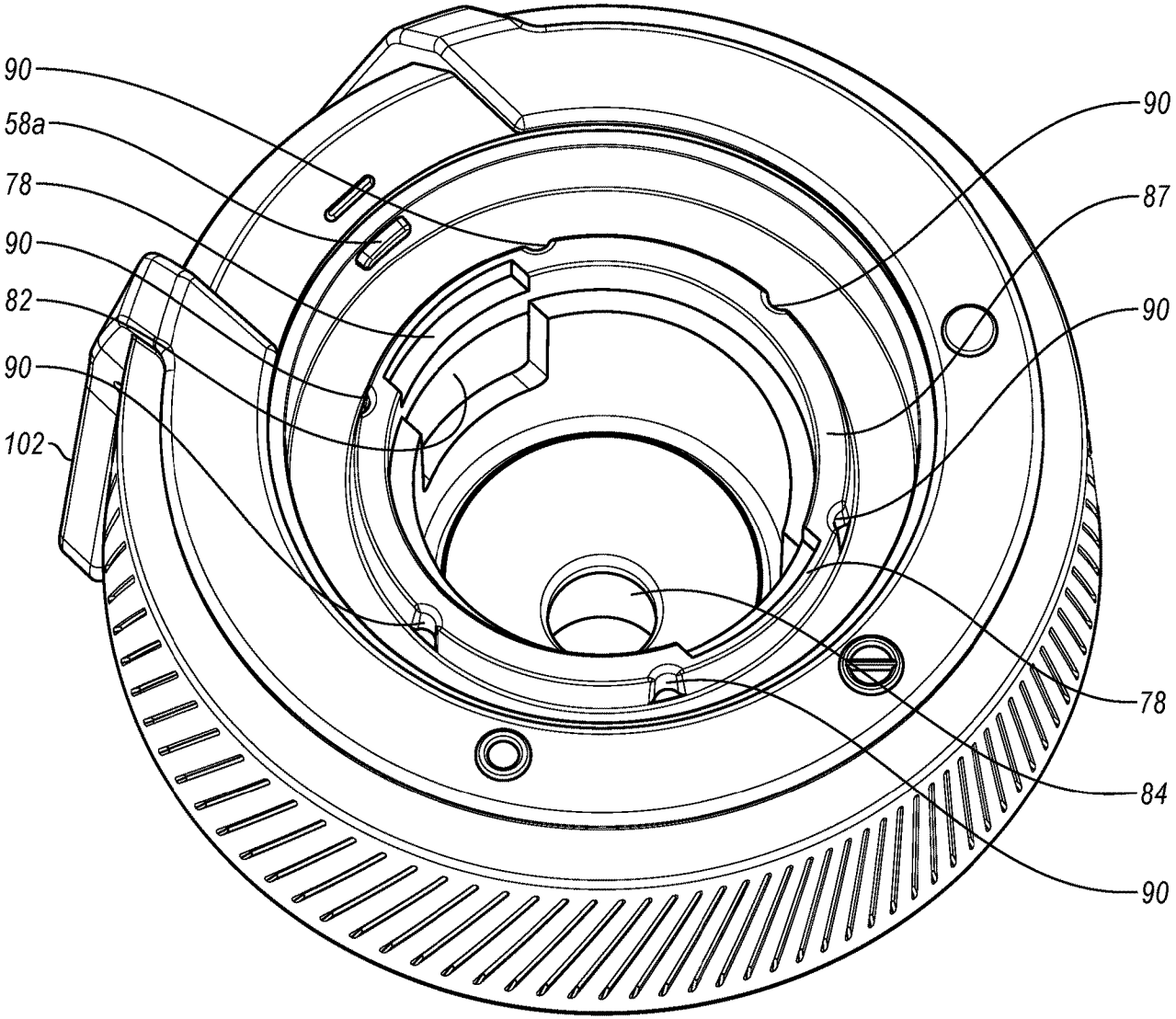
FIGS. 15A and 15B are enlarged, perspective views of another embodiment of a lid body.
Figure 15B:
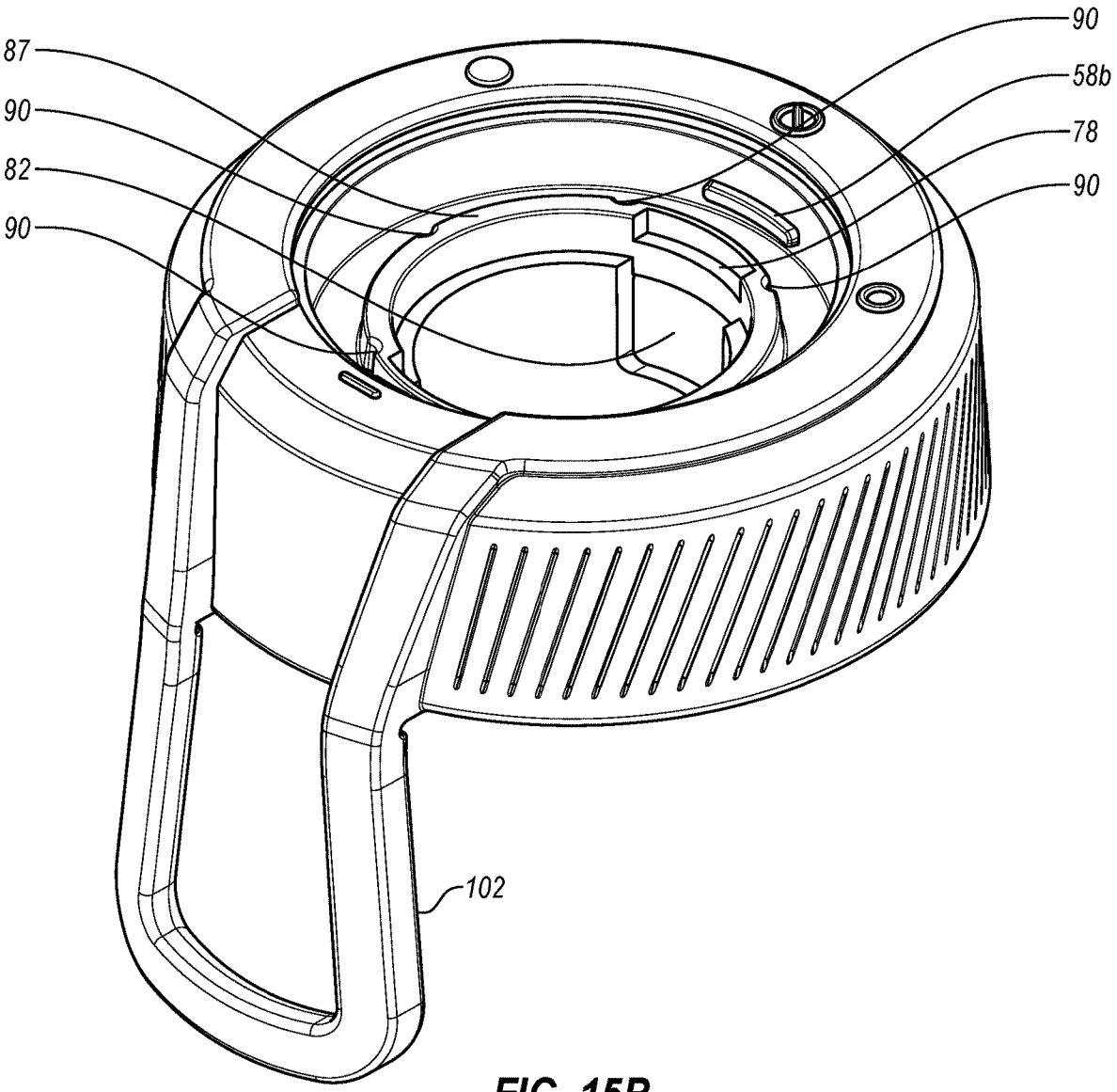
Figure 16B:
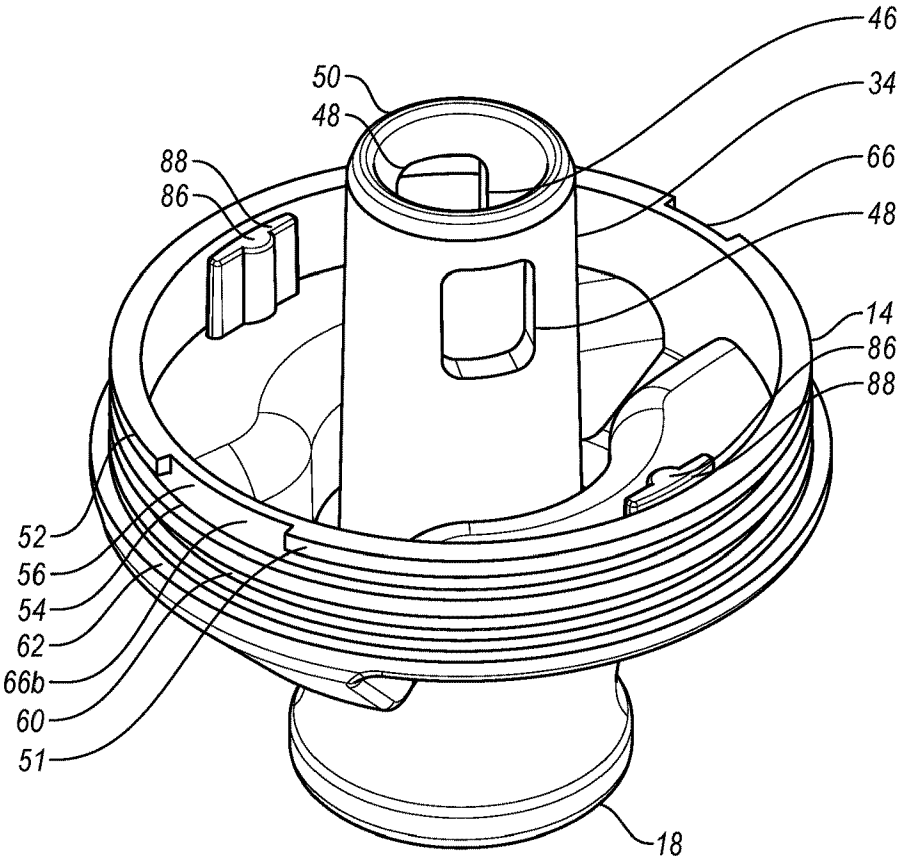
FIGS. 16A and 16B are enlarged, perspective views of another embodiment of a selector.
Figure 16A:
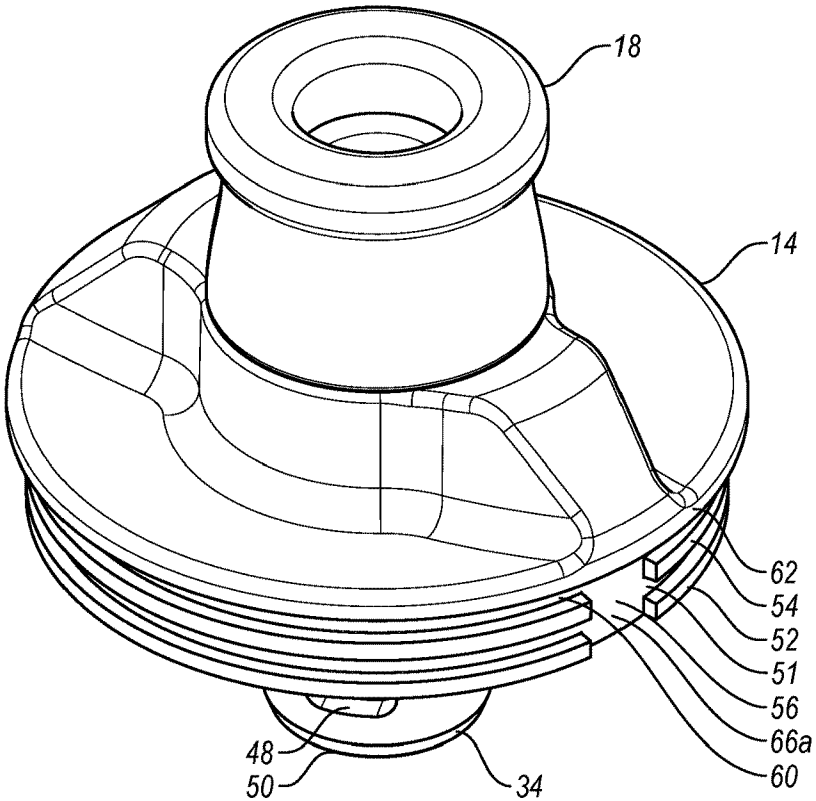

FIGS. 14A and 14B illustrate a lid body 12 with a carrying member 102. The carrying member 102 may be used as a handle. The carrying member 102 may comprise a partial or complete loop which may allow the container 10 to be easily and conveniently carried. The carrying member 102 may allow the container 10 to be easily connected to other structures such as by a clip, line, fastener, and the like. The carrying member 102 may be constructed from a material that permits repeated elastic deformations from a rest position, such as that illustrated in FIGS. 14A and 14B, and a positioned deflected outwardly from the rest position (e.g., by 15 degrees to 135 degrees) for use in carrying the container 10. The carrying member 102 may be coupled to the lid body. It will be appreciated that the carrying member 102, if present, may be attached to any suitable portion of the lid body 12 or to the vessel 30. In some embodiments, the carrying member 102 may be formed as a single, monolithic component with a partial or complete ring 112 extending partially or completely around another component of the container 10, such as the lid body 12, for example. In some embodiments, the carrying member 102, alone or together with the ring 112, can be molded over another component of the container 10, such as the lid body 12, for example.

The selector 14 may move between various positions depending, for example, upon the intended use of the container 10. The different positions could have functions or intended uses other than those explicitly disclosed herein. For example, when the selector 14 is in one open position, fluid may flow through the opening by squeezing and/or inverting the bottle, and when the selector 14 is in another open position, a user may drink from the straw 38 or fluid may be squeezed out of the container 10 through the straw 38. The valve assembly 36 may be closed when the selector is in any desired position relative to the bottle, such as in an intermediate or extended position. The order of the positions may vary from those expressly described and illustrated herein.

In some embodiments of the disclosed technology, for example as illustrated in FIG. 1, a container can be configured as a squeeze-type container from which fluids may be propelled from the container by squeezing the sides of the vessel, after which the sides may resiliently return to their original configuration when the squeezing pressure is no longer being applied. Although a squeeze-type container is illustrated in FIG. 1, the container can be configured not to be a squeeze-type container in some embodiments.

In some embodiments of the disclosed technology, the container can be used to store, transport, and/or dispense one or more liquids, such as water, beverages, drinks, juices, vitamin enhanced beverages, energy drinks, thirst-quenchers, flavored waters, protein drinks, shakes, foodstuffs, dressings, sauces, liquid meal replacements, solutions, suspensions, and the like. The container may also be used to store, transport, and/or dispense solutions and/or solids such as energy drinks, protein drinks, shakes, liquid meal replacements, etc.

In some embodiments, the container may be a shaker cup and the contents can be shaken, stirred, mixed and/or blended as desired, such as supplements, vitamins, protein powders, etc. This may allow the container to be used to create protein drinks, shakes, smoothies, dressings, sauces, etc. The container may be used as a water bottle in which water and other types of fluids can be transported and/or consumed. The container could further include foodstuffs such as fruits, vegetables, soups, and the like.

Advantageously, in some embodiments, the container may be reusable and refillable, which may allow the container to be used for many different purposes over an extended period of time. The container may also be easily carried and portable. For example, the container may be conveniently held in one-hand by the user. Additionally, the container may be insulated to help keep the contents at a desired temperature, such as at a lower or higher temperature.

In some embodiments, the container may include a small number of parts and components, which may facilitate manufacturing and assembly. In some embodiments, the container may be easily disassembled and cleaned. As discussed in greater detail below, the container may include a lid or cap that allows the container to be easily filled from various sources. The container, body, valve assembly, and lid can include any number of parts and components depending, for example, upon the intended use of the container.

A phrase such as "an aspect" does not imply that such aspect is essential to the subject technology or that such aspect applies to all configurations of the subject technology. A disclosure relating to an aspect may apply to all configurations, or one or more configurations. An aspect may provide one or more examples of the disclosure. A phrase such as "an aspect" may refer to one or more aspects and vice versa. A phrase such as "an embodiment" does not imply that such embodiment is essential to the subject technology or that such embodiment applies to all configurations of the subject technology. A disclosure relating to an embodiment may apply to all embodiments, or one or more embodiments. An embodiment may provide one or more examples of the disclosure. A phrase such "an embodiment" may refer to one or more embodiments and vice versa. A phrase such as "a configuration" does not imply that such configuration is essential to the subject technology or that such configuration applies to all configurations of the subject technology. A disclosure relating to a configuration may apply to all configurations, or one or more configurations. A configuration may provide one or more examples of the disclosure. A phrase such as "a configuration" may refer to one or more configurations and vice versa.

To the extent that the term "include," "have," or the like is used in the description or the claims, such term is intended to be inclusive in a manner similar to the term "comprise" as "comprise" is interpreted when employed as a transitional word in a claim.

A reference to an element in the singular is not intended to mean "one and only one" unless specifically stated, but rather "one or more." Pronouns in the masculine (e.g., his) include the feminine and neuter gender (e.g., her and its) and vice versa. The term "some" refers to one or more. Moreover, nothing disclosed herein is intended to be dedicated to the public regardless of whether such disclosure is explicitly recited in the above description.

Although the subject technology has been described in terms of certain embodiments, these have been presented by way of example only, and are not intended to limit the scope of the subject technology. Other embodiments apparent to those of ordinary skill in the art are also within the scope of the subject technology. The scope of the invention is intended to be defined only by the claims which follow.

What is claimed is:

1. A lid for a drinking vessel, the lid comprising:

a lid body;

a selector movable relative to the lid body between a closed position, a first open position and a second open position;

a conduit coupled with the selector, the conduit comprising a first conduit opening, a second conduit opening, and a third conduit opening;

a valve body comprising a first valve body opening and a second valve body opening; and a straw, wherein when the selector is in the closed position, fluid flow from a reservoir of an attached vessel is inhibited, wherein when the selector is in the first open position, fluid is able to be removed from the reservoir of the attached vessel along a first fluid pathway extending from the reservoir of the attached vessel through the straw, through the first valve body opening, through at least one of the first conduit opening and the second conduit opening, and through the third conduit opening, wherein when the selector is in the second open position, fluid is able to be removed from the reservoir of the attached vessel along a second fluid pathway extending from the reservoir of the attached vessel, through the second valve body opening, through at least one of the first conduit opening and the second conduit opening, and through the third conduit opening, and wherein the second fluid pathway does not extend through the straw.

2. The lid of claim 1, wherein the valve body comprises a third valve body opening, and wherein the second fluid pathway comprises:

a first pathway portion that extends from the reservoir of the attached vessel, through the second valve body opening, through the first conduit opening, and through the third conduit opening; and a second pathway portion that extends from the reservoir of the attached vessel, through the third valve body opening, through the second conduit opening, and through the third conduit opening.

3. The lid of claim 2, wherein the first conduit opening and the second conduit opening are aligned with the second valve body opening and the third valve body opening when the selector is in the second open position.

4. The lid of claim 1, wherein when the selector is in the first open position, the first fluid pathway is the only fluid pathway through the lid; and wherein when the selector is in the second open position, the second fluid pathway is the only fluid pathway through the lid.

5. The lid of claim 1, wherein when the selector is in the first open position, fluid is restricted from flowing through the second fluid pathway; and wherein when the selector is in the second open position, fluid is restricted from flowing through the first fluid pathway.

6. The lid of claim 1, wherein the selector and the conduit are formed as a unitary piece.

7. The lid of claim 1, wherein the first and second conduit openings are disposed in a sidewall of the conduit.

8. The lid of claim 1, wherein the first conduit opening and the second conduit opening are vertically offset from the first valve body opening.

9. The lid of claim 1, wherein the first conduit opening or the second conduit opening is aligned with the second valve body opening when the selector is in the second open position.

10. The lid of claim 1, wherein the selector is rotatable between the closed position, the first open position and the second open position.

11. A beverage container, comprising:

a vessel; and the lid of claim 1.

12. The lid of claim 1, wherein at least one of the first fluid pathway and the second fluid pathway comprises a first pathway portion that extends from the reservoir through the first conduit opening and a second pathway portion that extends from the reservoir through the second conduit opening.

13. The lid of claim 1, wherein the valve body is formed as a unitary piece.

14. A lid for a drinking vessel, the lid comprising:

a lid body;

a selector movable relative to the lid body between a closed position, a first open position and a second open position;

a conduit coupled with the selector, the conduit comprising a conduit opening disposed in a cylindrical sidewall of the conduit;

a valve body comprising a first valve body opening and a second valve body opening; and a straw, wherein when the selector is in the closed position, fluid flow from an attached vessel is inhibited, wherein when the selector is in the first open position, fluid is able to be removed from the attached vessel along a first fluid pathway extending from an interior of the attached vessel through the straw, the first valve body opening, and the conduit opening, wherein when the selector is in the second open position, fluid is able to be removed from the attached vessel along a second fluid pathway extending from the interior of the attached vessel through the second valve body opening and the conduit opening, and wherein the second fluid pathway does not extend through the straw.

15. The lid of claim 14, wherein the second valve body opening is disposed in a sidewall of the valve body.

16. The lid of claim 14, wherein the first valve body opening is disposed in a lower wall of the valve body.

17. The lid of claim 14, wherein when the selector is in the first open position, the first fluid pathway is the only fluid pathway through the lid; and wherein when the selector is in the second open position, the second fluid pathway is the only fluid pathway through the lid.

18. The lid of claim 14, wherein when the selector is in the first open position, fluid is restricted from flowing through the second fluid pathway; and wherein when the selector is in the second open position, fluid is restricted from flowing through the first fluid pathway.

19. The lid of claim 14, wherein the selector and the conduit are formed as a unitary piece.

20. The lid of claim 14, wherein the conduit opening is aligned with the second valve body opening when the selector is in the second open position.

21. The lid of claim 14, wherein the selector is rotatable between the closed position, the first open position and the second open position.

22. A beverage container, comprising:

a vessel; and the lid of claim 14.

* * * * *